US011256190B2

(12) United States Patent
Ikegami et al.

(10) Patent No.: US 11,256,190 B2
(45) Date of Patent: Feb. 22, 2022

(54) IMAGE FORMING APPARATUS

(71) Applicant: BROTHER KOGYO KABUSHIKI KAISHA, Nagoya (JP)

(72) Inventors: Yusuke Ikegami, Nagoya (JP); Shintaro Sakaguchi, Nagoya (JP); Toshiyuki Sano, Iwakura (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/124,802

(22) Filed: Dec. 17, 2020

(65) Prior Publication Data

US 2021/0223713 A1 Jul. 22, 2021

(30) Foreign Application Priority Data

Jan. 22, 2020 (JP) ..... JP2020-008686

(51) Int. Cl.
*G03G 15/08* (2006.01)
*G03G 21/18* (2006.01)

(52) U.S. Cl.
CPC ..... *G03G 15/0813* (2013.01); *G03G 21/1821* (2013.01)

(58) Field of Classification Search
CPC ..... G03G 15/0813; G03G 15/0896; G03G 21/1803; G03G 21/1821
See application file for complete search history.

(56) References Cited

U.S. PATENT DOCUMENTS

2010/0316400 A1* 12/2010 Murasaki ..... G03G 21/1821 399/49
2012/0014717 A1* 1/2012 Sugiyama ..... G03G 15/0121 399/228
2015/0277279 A1* 10/2015 Suzuki ..... G03G 15/234 399/53
2016/0231693 A1* 8/2016 Kitamura ..... G03G 21/1647
2017/0123366 A1* 5/2017 Tajiri ..... G03G 15/6564
2018/0074448 A1* 3/2018 Endoh ..... G03G 15/0813

FOREIGN PATENT DOCUMENTS

JP 2012-128017 A 7/2012

* cited by examiner

*Primary Examiner* — Carla J Therrien
(74) *Attorney, Agent, or Firm* — Scully, Scott, Murphy & Presser, P.C.

(57) ABSTRACT

A controller is configured to, when forming an image on one sheet, in a case where a length of one sheet in a conveyance direction is larger than a first length, drive a moving mechanism to move a plurality of developing rollers from a separation position to a contact position, temporarily stop driving of the moving mechanism, and then, at a first timing, again drive the moving mechanism to move the plurality of developing rollers from the contact position to the separation position; and in a case where the length of the one sheet in the conveyance direction is smaller than or equal to the first length, drive the moving mechanism to move the plurality of developing rollers from the separation position to the contact position and then to move the plurality of developing rollers from the contact position to the separation position without stopping driving of the moving mechanism.

11 Claims, 12 Drawing Sheets

IMAGE FORMING APPARATUS

CROSS REFERENCE TO RELATED APPLICATIONS

This application claims priority from Japanese Patent Application No. 2020-008686 filed Jan. 22, 2020. The entire content of the priority application is incorporated herein by reference.

TECHNICAL FIELD

This disclosure relates to an image forming apparatus.

BACKGROUND

An image forming apparatus is conventionally known which includes a plurality of photosensitive drums and a plurality of developing rollers configured to contact and separate from the corresponding photosensitive drums, and brings the developing rollers into contact with the corresponding photosensitive drums when performing printing.

SUMMARY

According to one aspect, this specification discloses an image forming apparatus. The image forming apparatus includes a plurality of photosensitive drums, a plurality of developing rollers, a moving mechanism, and a controller. The plurality of photosensitive drums includes a first photosensitive drum and a second photosensitive drum. The second photosensitive drum is disposed downstream of the first photosensitive drum in a conveyance direction of a sheet. The plurality of developing rollers includes a first developing roller and a second developing roller. The first developing roller is configured to move between a contact position at which the first developing roller contacts the first photosensitive drum and a separation position at which the first developing roller is separated from the first photosensitive drum. The second developing roller is configured to move between a contact position at which the second developing roller contacts the second photosensitive drum and a separation position at which the second developing roller is separated from the second photosensitive drum. The moving mechanism is configured to move the plurality of developing rollers between the contact position and the separation position such that, when the plurality of developing rollers moves from the separation position to the contact position, the second developing roller moves to the contact position after the first developing roller moves to the contact position, and when the plurality of developing rollers moves from the contact position to the separation position, the second developing roller moves to the separation position after the first developing roller moves to the separation position. The controller is configured to, when forming an image on one sheet, in a case where a length of the one sheet in the conveyance direction is larger than a first length, drive the moving mechanism to move the plurality of developing rollers from the separation position to the contact position, temporarily stop driving of the moving mechanism, and then, at a first timing, again drive the moving mechanism to move the plurality of developing rollers from the contact position to the separation position; and in a case where the length of the one sheet in the conveyance direction is smaller than or equal to the first length, drive the moving mechanism to move the plurality of developing rollers from the separation position to the contact position and then to move the plurality of developing rollers from the contact position to the separation position without stopping driving of the moving mechanism.

According to another aspect, this specification also discloses an image forming apparatus. The image forming apparatus includes a photosensitive drum, a developing roller, a cam, and a controller. The developing roller is configured to move between a contact position at which the developing roller contacts the photosensitive drum and a separation position at which the developing roller is separated from the photosensitive drum. The cam is configured to rotate to move the developing roller between the contact position and the separation position. The controller is configured to, when forming an image on one sheet, in a case where a length of the one sheet in the conveyance direction is larger than a particular length, rotate the cam to move the developing roller from the separation position to the contact position, temporarily stop rotation of the cam, and then at a particular timing again rotate the cam to move the developing roller from the contact position to the separation position; and in a case where the length of the one sheet in the conveyance direction is smaller than or equal to the particular length, rotate the cam to move the developing roller from the separation position to the contact position and then to move the developing roller from the contact position to the separation position without stopping rotation of the cam.

According to still another aspect, this specification also discloses an image forming apparatus. The image forming apparatus includes a plurality of photosensitive drums, a plurality of developing rollers, a moving mechanism, and a controller. The plurality of photosensitive drums includes a first photosensitive drum and a second photosensitive drum. The second photosensitive drum is disposed downstream of the first photosensitive drum in a conveyance direction of a sheet. The plurality of developing rollers includes a first developing roller and a second developing roller. The first developing roller is configured to move between a contact position at which the first developing roller contacts the first photosensitive drum and a separation position at which the first developing roller is separated from the first photosensitive drum. The second developing roller is configured to move between a contact position at which the second developing roller contacts the second photosensitive drum and a separation position at which the second developing roller is separated from the second photosensitive drum. The moving mechanism is configured to move the plurality of developing rollers between the contact position and the separation position such that, when the plurality of developing rollers moves from the separation position to the contact position, the second developing roller moves to the contact position after the first developing roller moves to the contact position, and when the plurality of developing rollers moves from the contact position to the separation position, the second developing roller moves to the separation position after the first developing roller moves to the separation position. The moving mechanism is configured such that, when driven continuously, the plurality of developing rollers is maintained at the contact position for a certain time after the second developing roller moves to the contact position and until the first developing roller starts moving from the contact position to the separation position. The controller is configured to, when driving the moving mechanism to move the plurality of developing rollers from the separation position to the contact position for forming an image on one sheet: in a case where a trailing end of the one sheet has not passed a first position at a timing when the second developing roller moves to the contact position, temporarily stop driving of the moving mechanism and then at a particular timing again drive the moving mechanism to move the plurality of developing rollers from the contact position to the separation position; and in a case where the trailing end of the one sheet has passed the first position at the timing when the second developing roller moves to the contact position, move the plurality of developing rollers from the contact position to the separation position without stopping driving of the moving mechanism. The first position is a position on a sheet conveyance path and upstream of a transfer position by a first distance in the conveyance direction. The first distance is a distance from a developing position to the transfer position along a circumferential surface of the first photosensitive drum. The developing position is a position at which an electrostatic latent image on the first photosensitive drum is developed to form a toner image. The transfer position is a position at which the toner image formed on the first photosensitive drum is transferred onto the sheet.

BRIEF DESCRIPTION OF THE DRAWINGS

Embodiments in accordance with this disclosure will be described in detail with reference to the following figures wherein.

DETAILED DESCRIPTION

In an image forming apparatus that forms a toner image on a photosensitive drum by contact development, it is desirable to shorten the contact time between a developing roller and the photosensitive drum as much as possible in order to prolong the life of the developing roller and so on.

In view of the foregoing, an aspect of an objective of this disclosure is to provide an image forming apparatus that shortens the contact time between a developing roller and a photosensitive drum.

Figure 1:
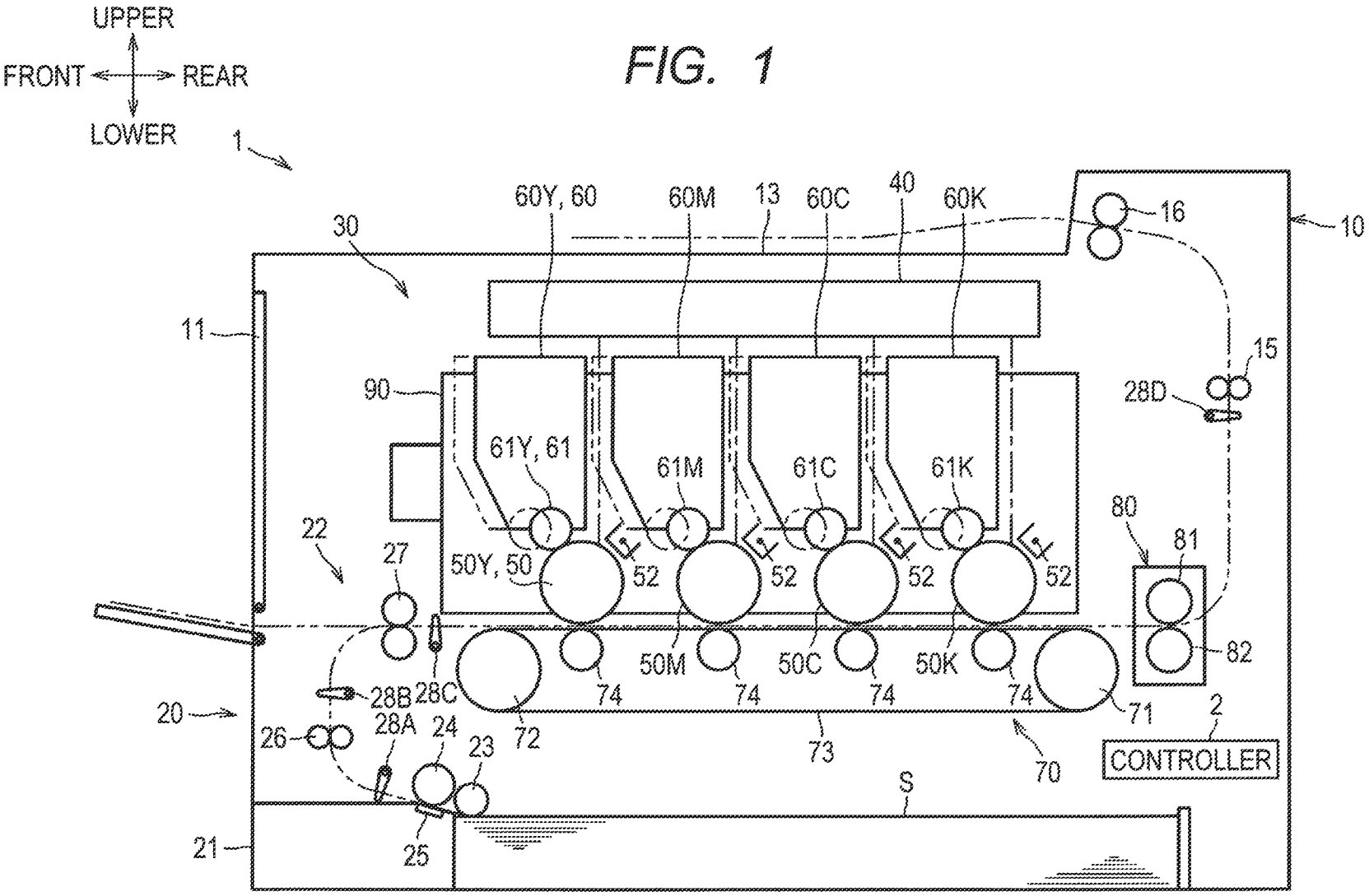
FIG. 1 is a schematic diagram showing the configuration of an image forming apparatus according to an embodiment.

As shown in FIG. 1, an image forming apparatus 1 according to an embodiment is a color printer, and includes a housing 10, a sheet feed unit 20, an image forming unit 30, and a controller 2. In this embodiment, the left side of FIG. 1 is the front, the right side is the rear, the upper and lower are the upper and lower as they are, the near side in the direction perpendicular to the drawing surface of FIG. 1 is the right side, and the far side is the left side.

The sheet feed unit 20 includes a sheet tray 21 in which a sheet S is set and a feed mechanism 22. The sheet tray 21 is arranged below the image forming unit 30, and configured to be removed by pulling the same forward from the housing 10. The feed mechanism 22 includes a paper feed roller 23, a separation roller 24, a separation pad 25, a conveyance roller 26, and a registration roller 27. The sheet S is a medium on which an image can be formed with the image forming apparatus 1, and includes plain paper, envelopes, postcards, thin paper, thick paper, glossy paper, resin sheets, stickers, and so on.

The sheet S accommodated in the sheet tray 21 is sent out by the paper feed roller 23, then separated one sheet at a time between the separation roller 24 and the separation pad 25, and is conveyed toward the registration roller 27 by the conveyance roller 26. After that, after the position of the leading end of the sheet S is regulated by the registration roller 27 in a state where the rotation thereof is stopped, the sheet S is supplied to the image forming unit 30 by rotation of the registration roller 27.

The image forming apparatus 1 includes a paper feed sensor 28A for detecting a sheet S, a pre-registration sensor 28B, and a post-registration sensor 28C. In this embodiment, the post-registration sensor 28C is an example of "sheet sensor". The paper feed sensor 28A, the pre-registration sensor 28B, and the post-registration sensor 28C are arranged upstream of a plurality of photosensitive drums 50, which will be described later, in the conveyance direction of the sheet S. The paper feed sensor 28A is arranged downstream of the paper feed roller 23 and the separation roller 24 in the conveyance direction of the sheet S. The pre-registration sensor 28B is arranged downstream of the paper feed sensor 28A and the conveyance roller 26 and upstream of the registration roller 27 in the conveyance direction of the sheet S. The post-registration sensor 28C is arranged downstream of the registration roller 27 in the conveyance direction of the sheet S.

The image forming unit 30 includes an exposure device 40, the plurality of photosensitive drums 50, a plurality of developing cartridges 60, a conveyance device 70, and a fixing device 80. The exposure device 40 includes a laser diode, a deflector, a lens, and a mirror (not shown). The exposure device 40 is configured to expose the surface of each photosensitive drum 50 by emitting a plurality of light beams indicated by single-dot chain lines for exposing the plurality of photosensitive drums 50.

The plurality of photosensitive drums 50 includes a Y photosensitive drum 50Y corresponding to yellow, an M photosensitive drum 50M corresponding to magenta, a C photosensitive drum 50C corresponding to cyan, and a K photosensitive drum 50K corresponding to black. In this embodiment, the Y photosensitive drum 50Y is an example of "first photosensitive drum", the M photosensitive drum 50M is an example of "third photosensitive drum", the C photosensitive drum 50C is an example of "second photosensitive drum", and the K photosensitive drum 50K is an example of "fourth photosensitive drum". The "plurality of photosensitive drums" of this disclosure are the Y photosensitive drum 50Y, the M photosensitive drum 50M, and the C photosensitive drum 50C. In the present specification and the drawings, regarding the members provided for respective colors, when the colors of the members are distinguished, Y, M, C, and K are added to the reference signs and, when the colors are not distinguished, Y, M, C, K are not added to the reference signs.

The C photosensitive drum 50C is located downstream of the Y photosensitive drum 50Y in the conveyance direction of the sheet S. The M photosensitive drum 50M is arranged between the Y photosensitive drum 50Y and the C photosensitive drum 50C in the conveyance direction of the sheet S. The K photosensitive drum 50K is arranged downstream of the C photosensitive drum 50C in the conveyance direction of the sheet S. That is, the photosensitive drums 50Y, 50M, 50C, and 50K are arranged side by side in this order from the upstream to the downstream of the conveyance direction of the sheet S.

The developing cartridge 60 is provided for each of the plurality of photosensitive drums 50 in a one-to-one correspondence. The plurality of developing cartridges 60 includes a Y developing cartridge 60Y having a Y developing roller 61Y for supplying toner to the Y photosensitive drum 50Y, an M developing cartridge 60M having an M developing roller 61M for supplying toner to the M photosensitive drum 50M, a C developing cartridge 60C having a C developing roller 61C for supplying toner to the C photosensitive drum 50C, and a K developing cartridge 60K having a K developing roller 61K for supplying toner to the K photosensitive drum 50K.

The developing rollers 61Y, 61M, 61C, and 61K are arranged in this order from the upstream to the downstream of the conveyance direction of the sheet S. In this embodiment, the Y developing roller 61Y is an example of "first developing roller", the M developing roller 61M is an example of "third developing roller", the C developing roller 61C is an example of "second developing roller", and the K developing roller 61K is an example of "fourth developing roller". The "plurality of developing rollers" of this disclosure are the Y developing roller 61Y, the M developing roller 61M, and the C developing roller 61C.

Each developing cartridge 60 is configured to move between a position shown by solid lines in FIG. 1 where the developing roller 61 is at a contact position at which the developing roller 61 is in contact with the corresponding photosensitive drum 50 and a position shown by double-dot chain line in FIG. 1 where the developing roller 61 is at a separation position at which the developing roller 61 is separated from the corresponding photosensitive drum 50.

The plurality of photosensitive drums 50 are rotatably supported by a support member 90. The support member 90 is provided with chargers 52 arranged for corresponding ones of the photosensitive drum 50 and for charging the photosensitive drums 50. The support member 90 is attachable to and detachable from the housing 10 through an opening formed by opening a front cover 11 of the housing 10. The support member 90 detachably supports the plurality of developing cartridges 60.

The conveyance device 70 is provided between the sheet tray 21 and the plurality of photosensitive drums 50. The conveyance device 70 includes a drive roller 71, a follow roller 72, a conveyance belt 73 which is an endless belt, and four transfer rollers 74. The conveyance belt 73 is stretched between the drive roller 71 and the follow roller 72, and the outer surface thereof is arranged to face each photosensitive drum 50. Each transfer roller 74 is arranged inside the conveyance belt 73 so as to sandwich the conveyance belt 73 with each photosensitive drum 50.

The fixing device 80 is provided at the rear of the plurality of photosensitive drums 50 and the conveyance device 70. The fixing device 80 includes a heating roller 81 and a pressure roller 82 arranged to face the heating roller 81. A paper discharge sensor 28D configured to detect the passage of a sheet S, a conveyance roller 15, and a discharge roller 16 are provided downstream of the fixing device 80 in the conveyance direction of the sheet S.

In the image forming unit 30, the surface of the photosensitive drum 50 is uniformly charged by the charger 52, and is then exposed by a light beam emitted from the exposure device 40. As a result, an electrostatic latent image based on image data is formed on the photosensitive drum 50. Further, the toner contained in the developing cartridge 60 is borne on the surface of the developing roller 61, and is supplied from the developing roller 61 located at the contact position to the electrostatic latent image formed on the photosensitive drum 50. As a result, a toner image is formed on the photosensitive drum 50. Next, the sheet S fed on the conveyance belt 73 is conveyed on the conveyance belt 73 and passes between the photosensitive drum 50 and the transfer roller 74, so that the toner image on the photosensitive drum 50 is transferred to the sheet S. Then, when the sheet S passes between the heating roller 81 and the pressure roller 82, the toner image is thermally fixed to the sheet S. After that, the sheet S is discharged onto the paper discharge tray 13 by the conveyance roller 15 and the discharge roller 16.

Figure 2:
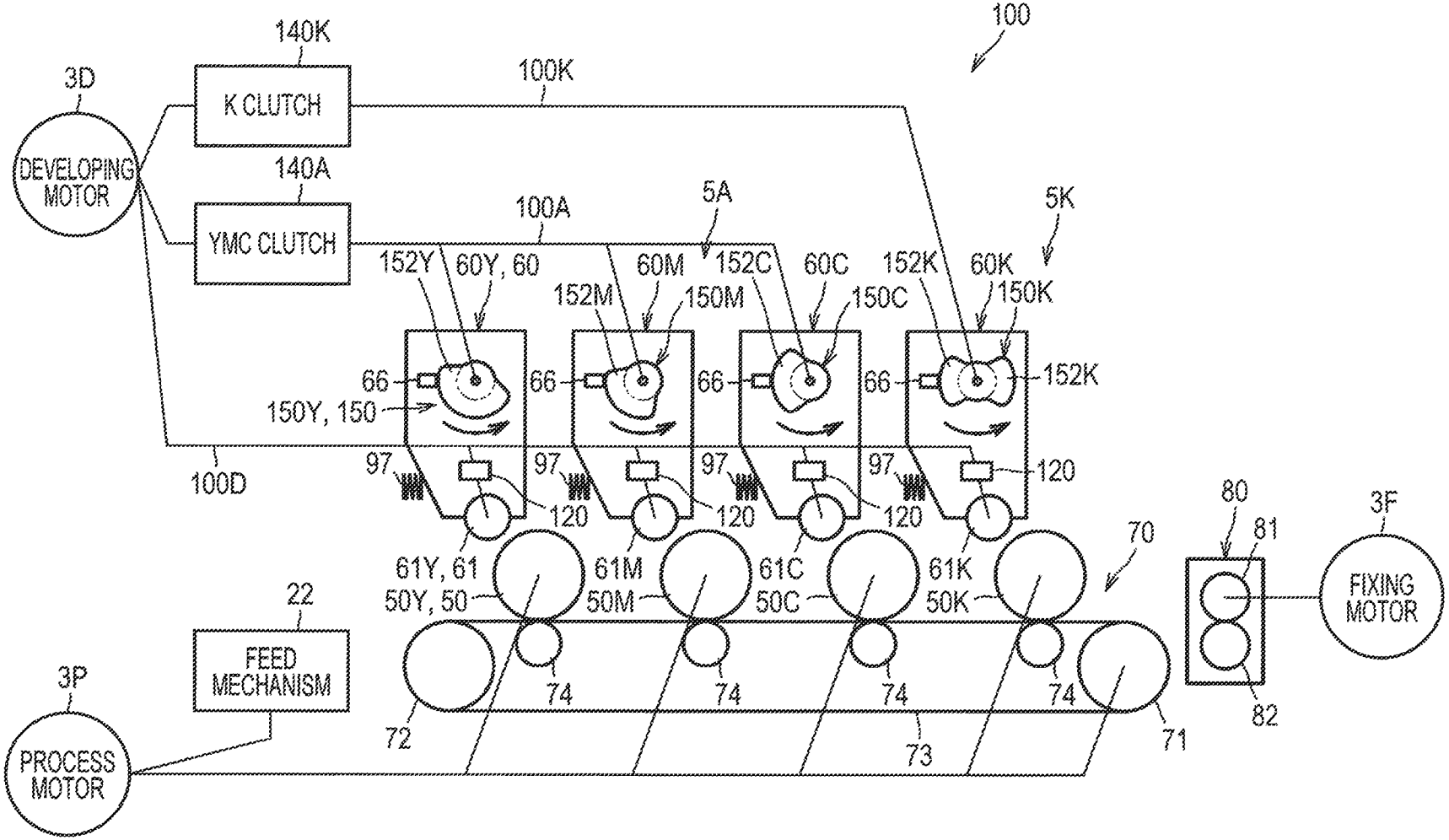
FIG. 2 shows an example of the configuration in which developing rollers contact and separate from photosensitive drums.

As shown in FIG. 2, the image forming apparatus 1 includes a first moving mechanism 5A and a second moving mechanism 5K. The first moving mechanism 5A is configured such that three developing rollers 61Y, 61M, and 61C are moved between the contact position and the separation position. The second moving mechanism 5K is configured such that one K developing roller 61K moves between the contact position and the separation position. In this embodiment, the first moving mechanism 5A is an example of "moving mechanism".

The first moving mechanism 5A has a Y cam 150Y that is rotated to move the Y developing roller 61Y between the contact position and the separation position, an M cam 150M that is rotated to move the M developing roller 61M between the contact position and the separation position; and a C cam 150C that is rotated to move the C developing roller 61C between the contact position and the separation position. The second moving mechanism 5K has a K cam 150K that is rotated to move the K developing roller 61K between the contact position and the separation position. In this embodiment, the K cam 150K is an example of "cam".

The following section will describe one example of a configuration (including the cam 150) for causing the developing roller 61 to contact the corresponding photosensitive drum 50 and to separate from the photosensitive drum 50.

A support member 90 (see FIG. 1) supports each developing cartridge 60 such that the developing cartridge 60 is movable in a direction along which the plurality of the photosensitive drums 50 are arranged (that is, the conveyance direction of the sheet S on the conveying belt 73). The support member 90 has a spring 97 that urges the developing cartridge 60 from upstream to downstream in the conveyance direction of the sheet S. The spring 97 is provided for each developing cartridge 60.

Each developing cartridge 60 has, on a side face thereof, a pressed portion 66 protruding in the rotation axis direction of the developing roller 61. The developing cartridge 60 is configured such that, when the cam 150 presses the pressed portion 66 from downstream to upstream in the conveyance direction of the sheet S, the developing cartridge 60 moves against the urging force of the spring 97 to a separation position at which the developing roller 61 is separated from the corresponding photosensitive drum 50. When the pressing by the cam 150 is stopped, the developing cartridge 60 moves to a contact position at which the developing roller 61 contacts the corresponding photosensitive drum 50 by the urging force of the spring 97.

The cam 150 is rotatable about an axis parallel to the rotation axis of the developing roller 61. Each of the cams 150Y, 150M, and 150C has a single cam protrusion 152Y, 152M, and 152C, respectively, on the outer peripheral surface thereof. The K cam 150K has two substantially-symmetrical cam protrusions 152K on the outer peripheral surface thereof. The cam protrusions 152Y, 152M, 152C, and 152K are configured to press the pressed portions 66 of the developing cartridges 60. The developing roller 61 is located at the separation position in a state where the cam protrusions 152Y, 152M, 152C, and 152K press the pressed portion 66 (that is, in a state where the cams 150Y, 150M, and 150C are located in particular angular ranges). The developing roller 61 is located at the contact position in a state where the pressed portion 66 is not pressed by the cam protrusions 152Y, 152M, 152C, and 152K.

In this embodiment, the M cam 150M and the C cam 150C have the same shape. The length of the cam protrusion 152Y of the Y cam 150Y in the rotational direction is longer than those of the cam protrusions 152M and 152C of the cams 150M and 150C. The length of each cam protrusion 152K of the K cam 150K in the rotational direction is shorter than those of the cam protrusions 152Y, 152M, and 152C. The respective cams 150 rotate at substantially the same rotation speed, and a time TR required for one rotation is substantially the same for the cams 150.

Figure 3:
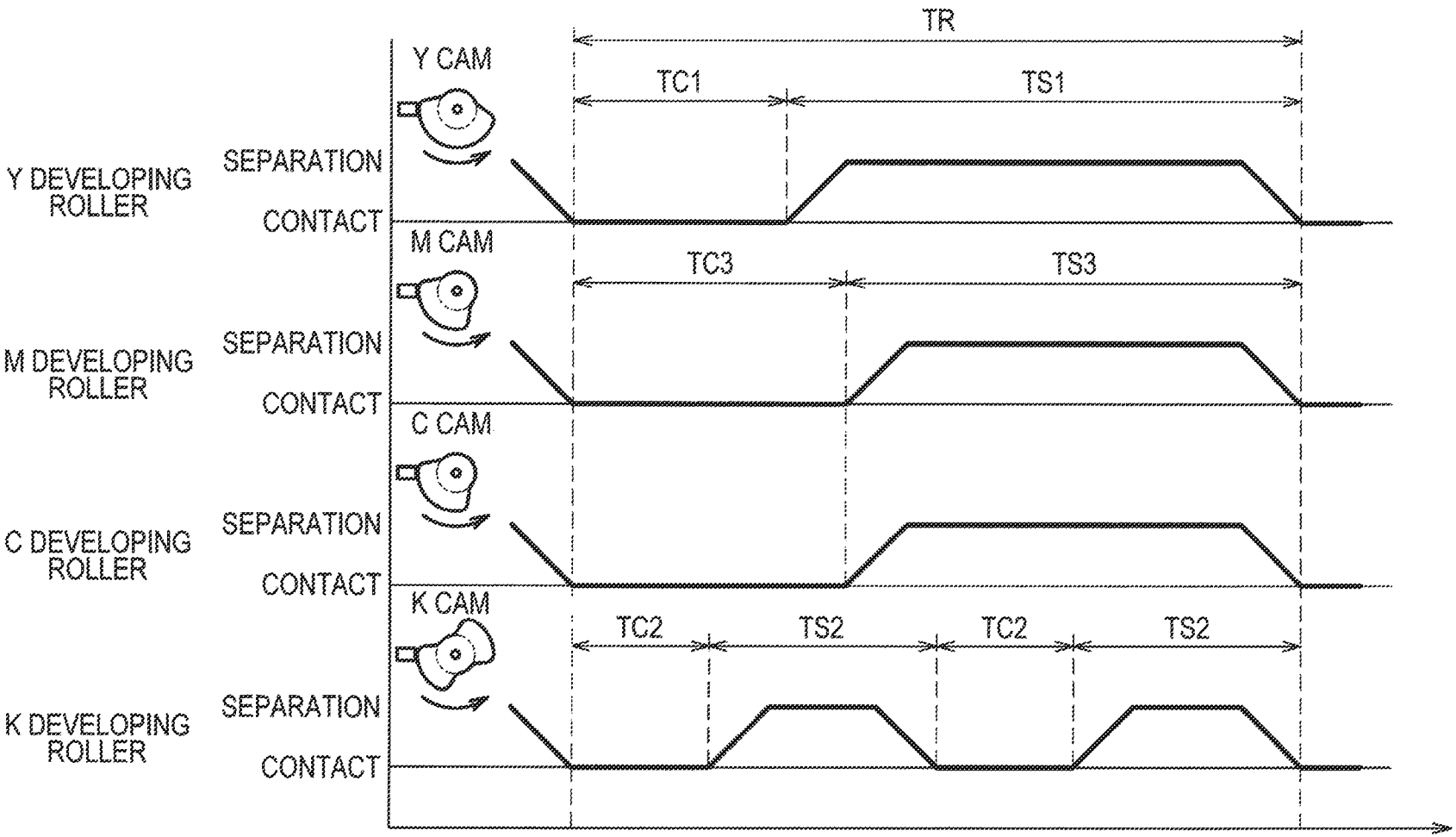
FIG. 3 is a diagram showing a profile of each cam.
Figure 4A:
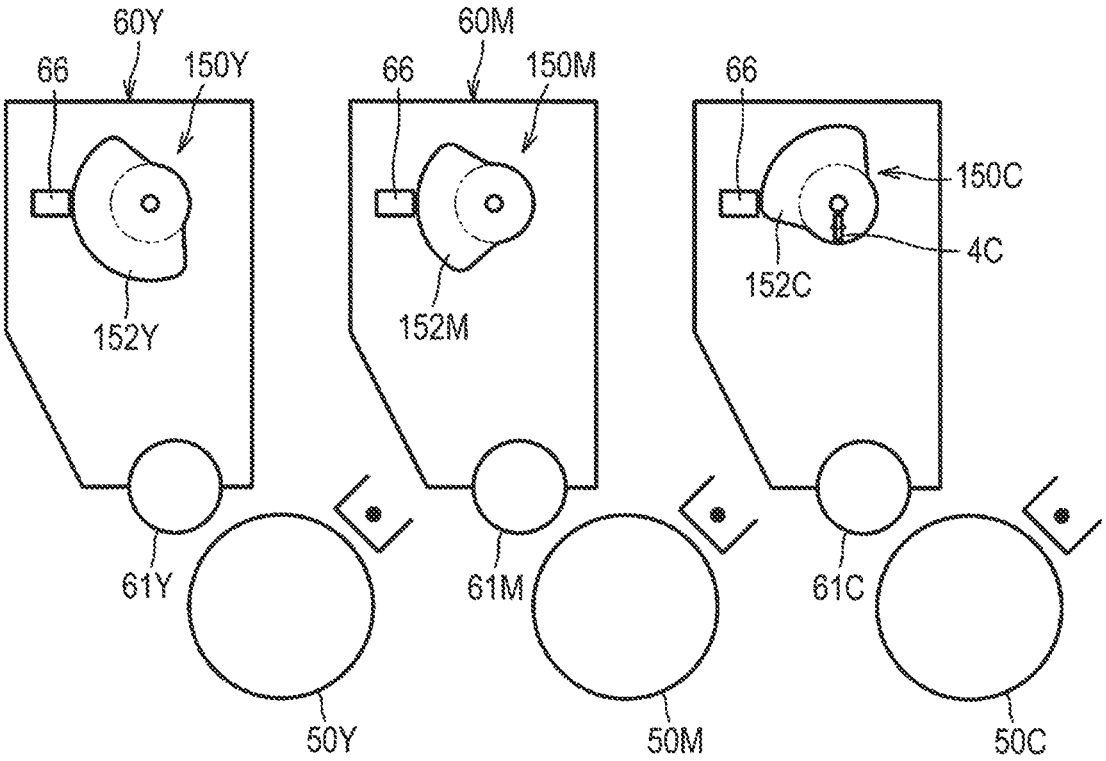
FIGS. 4A and 4B are explanatory diagrams showing a cyan separation sensor and a first detected portion provided at a C cam.
Figure 4B:
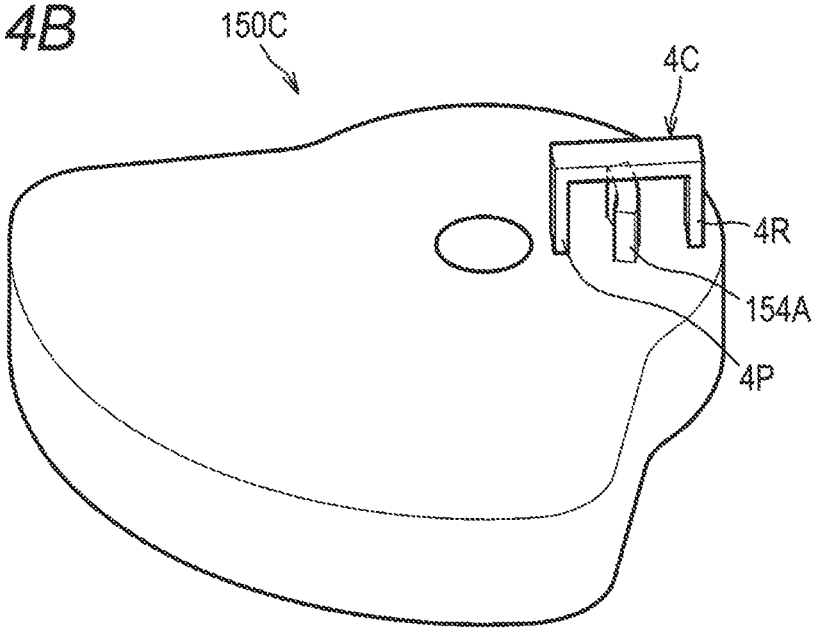
Figure 5A:
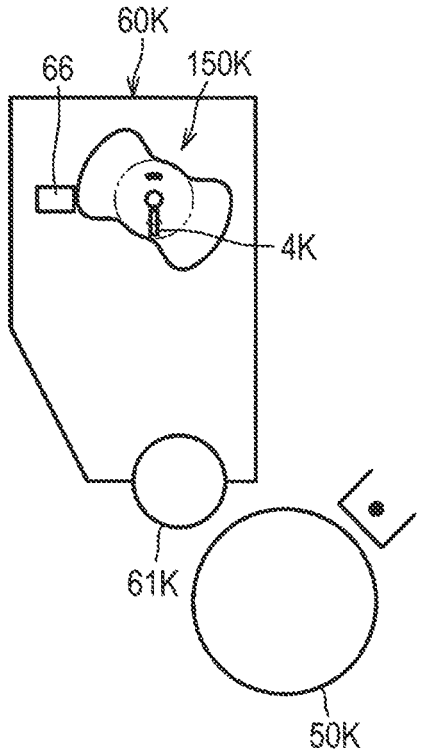
FIGS. 5A and 5B are explanatory diagrams showing a black separation sensor and a second detected portion provided at a K cam.
Figure 5B:
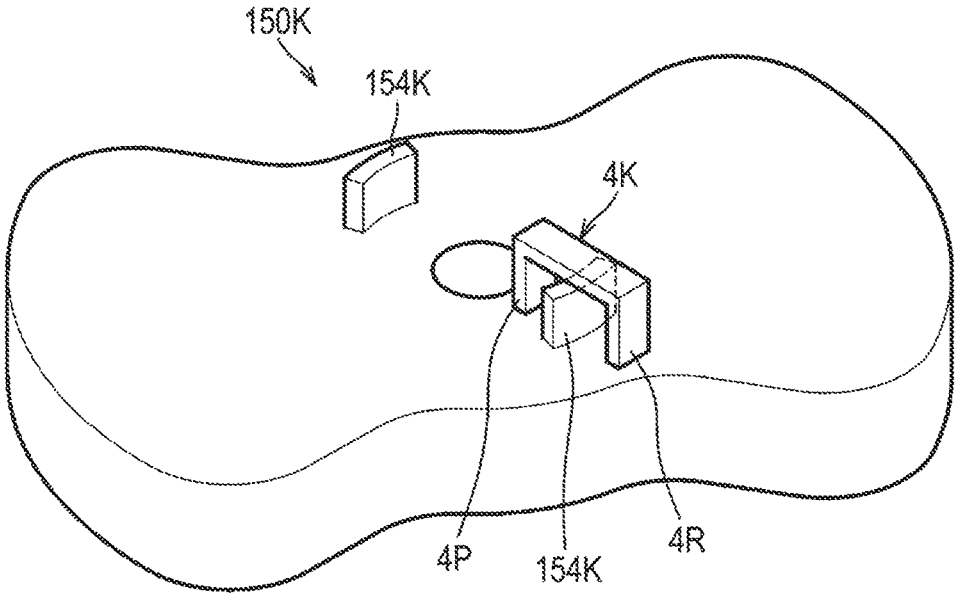

As described above, as shown in FIG. 3, a second separation time TS2 of the K cam 150K is shorter than a first separation time TS1 of the Y cam 150Y. The second separation time TS2 of the K cam 150K is shorter than a third separation time TS3 of the cams 150M and 150C.

The first separation time TS1 is the time from when the Y developing roller 61Y at the contact position starts separating from the Y photosensitive drum 50Y until the Y developing roller 61Y again contacts the Y photosensitive drum 50Y due to continuous rotation of the Y cam 150Y. The second separation time TS2 is the time from when the K developing roller 61K at the contact position starts separating from the K photosensitive drum 50K until the K developing roller 61K again contacts the K photosensitive drum 50K due to continuous rotation of the K cam 150K. The third separation time TS3 is the time from when the M developing roller 61M (the C developing roller 61C) at the contact position starts separating from the M photosensitive drum 50M (the C photosensitive drum 50C) until the M developing roller 61M (the C developing roller 61C) again contacts the M photosensitive drum 50M (the C photosensitive drum 50C) due to continuous rotation of the M cam 150M (the C cam 150C).

Returning to FIG. 2, the image forming apparatus 1 includes a developing motor 3D, a process motor 3P, a fixing motor 3F, and a driving transmission mechanism 100. In this embodiment, the developing motor 3D is an example of "motor".

The process motor 3P is a motor that transmits driving force to the feed mechanism 22, the plurality of photosensitive drums 50, and the drive roller 71 of the conveyance device 70, and so on. The fixing motor 3F is a motor that transmits driving force to the heating roller 81 of the fixing device 80.

The driving transmission mechanism 100 has a first gear train 100A that transmits the driving force of the developing motor 3D to the cams 150Y, 150M, and 150C; a second gear train 100K that transmits the driving force of the developing motor 3D to the K cam 150K; and a third gear train 100D that transmits the driving force of the developing motor 3D to the developing roller 61. The Y cam 150Y, the M cam 150M, and the C cam 150C are mechanically connected via gears and are configured to be simultaneously rotated by the transmission of the driving force of the developing motor 3D.

The first gear train 100A has a YMC clutch 140A. The YMC clutch 140A is an electromagnetic clutch that switches the driving force of the developing motor 3D between a transmission state to transmit the driving force to the cams 150Y, 150M, and 150C and a cutoff state to not transmit the driving force to the cams 150Y, 150M, and 150C. The second gear train 100K has a K clutch 140K. The K clutch 140K is an electromagnetic clutch that switches the driving force of the developing motor 3D between the transmission state to transmit the driving force to the K cam 150K and the cutoff state to not transmit the driving force to the K cam 150K. In the following description, when the clutches 140A and 140K are in the transmission state, the state may be said to be "ON" and when the clutches 140A and 140K are in the cutoff state, the state may be said to be "OFF".

The third gear train 100D has a plurality of mechanical clutches 120, each of which is provided for a corresponding one of the plurality of developing rollers 61. The mechanical clutch 120 is configured to transmit the driving force from the developing motor 3D to the developing roller 61 located at the contact position and to not transmit the driving force from the developing motor 3D to the developing roller 61 located at the separation position. The mechanical clutch 120 transmits the driving force to rotate the developing roller 61 when the developing roller 61 is in the middle of moving from the separation position to the contact position before contacting the corresponding photosensitive drum 50. The mechanical clutch 120 cuts off transmission of the driving force to stop the rotation of the developing roller 61 when the developing roller 61 is in the middle of moving from the contact position to the separation position after separating from the corresponding photosensitive drum 50. In this manner, the developing roller 61 rotates when the developing roller 61 is located at the contact position, and the developing roller 61 does not rotate when the developing roller 61 is located at the separation position.

The first moving mechanism 5A is configured such that, when moving the developing rollers 61Y, 61M, and 61C from the separation position to the contact position, the M developing roller 61M moves to the contact position after the Y developing roller 61Y moves to the contact position and before the C developing roller 61C moves to the contact position, and subsequently the C developing roller 61C moves to the contact position. The first moving mechanism 5A is configured such that, when moving the developing rollers 61Y, 61M, and 61C from the contact position to the separation position, the M developing roller 61M moves to the separation position after the Y developing roller 61Y moves to the separation position and before the C developing roller 61C moves to the separation position, and subsequently the C developing roller 61C moves to the separation position.

In particular, the cams 150Y, 150M, and 150C of the first moving mechanism 5A are assembled such that the phases of the cam protrusions 152Y, 152M, and 152C are shifted by particular angles. Specifically, regarding the Y cam 150Y and the M cam 150M, the upstream ends of the cam protrusions 152Y and 152M in the rotational direction have the same phase. Regarding the C cam 150C, the phase of the upstream end of the cam protrusion 152C in the rotational direction is shifted relative to those of the cams 150Y and 150M by a particular angle. Further, regarding the cams 150Y, 150M, and 150C, the phases of the downstream ends of the cam protrusions 152Y, 152M, and 152C in the rotational direction are shifted by particular angles.

In this manner, when moving the developing rollers 61Y, 61M, and 61C from the separation position to the contact position, the controller 2 turns on the YMC clutch 140A to transmit the driving force from the developing motor 3D to the cams 150Y, 150M, and 150C, and then the cams 150Y, 150M, and 150C are rotated simultaneously. Then, as the sheet S is fed, the Y developing roller 61Y firstly starts moving toward the contact position and the M developing roller 61M starts moving toward the contact position at substantially the same timing as that of the Y developing roller 61Y. Thereafter, the C developing roller 61C starts moving toward the contact position. In this manner, the Y developing roller 61Y and the M developing roller 61M move to the contact position substantially simultaneously. After the Y developing roller 61Y and the M developing roller 61M move to the contact position, the C developing roller 61C moves to the contact position.

When moving the developing rollers 61Y, 61M, and 61C from the contact position to the separation position, the controller 2 turns on the YMC clutch 140A and the driving force from the developing motor 3D is transmitted to the cams 150Y, 150M, and 150C, the cams 150Y, 150M, and 150C are rotated simultaneously. As the sheet S moves, the Y developing roller 61Y, the M developing roller 61M, and the C developing roller 61C start moving toward the separation position in this order. As a result, the developing rollers 61Y, 61M, and 61C move to the separation position in this order.

Figure 8:
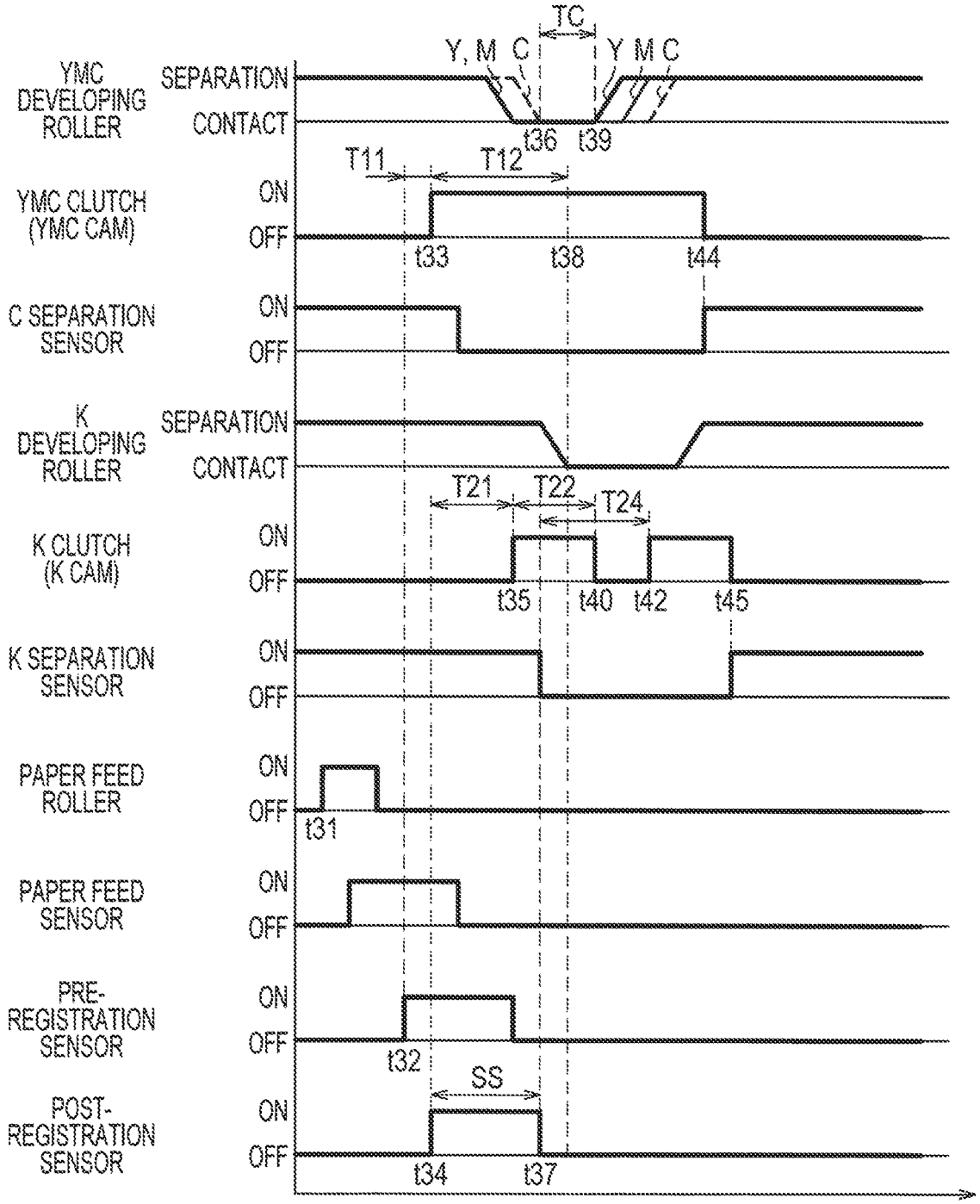
FIG. 8 is a timing chart showing operations of the developing rollers and the clutches when the length of a sheet is short in a case where a color image is formed on one sheet.

As shown in FIG. 8, the first moving mechanism 5A is configured such that, when the cams 150Y, 150M, and 150C are rotated continuously, the three developing rollers 61Y, 61M, and 61C are maintained at the contact position during a certain time TC from time t36 at which the C developing roller 61C moves to the contact position until time t39 at which the Y developing roller 61Y starts moving from the contact position toward the separation position.

The second moving mechanism 5K is driven independently from the first moving mechanism 5A by being controlled by the controller 2. Specifically, the K cam 150K of the second moving mechanism 5K rotates independently from the cams 150Y, 150M, and 150C due to the ON/OFF control of the K clutch 140K by the controller 2.

When all of the developing rollers 61 are used to form a color image on the sheet S, the controller 2 controls the K cam 150K to operate with a phase which is later than the phase of the C cam 150C by a particular angle.

Specifically, when moving the K developing roller 61K from the separation position to the contact position, the controller 2 turns on the K clutch 140K at a particular contact timing and the driving force from the developing motor 3D is transmitted to the K cam 150K. Then, the K cam 150K rotates and, as the sheet S moves, the K developing roller 61K starts moving toward the contact position at later timing than the C developing roller 61C. As a result, after the developing rollers 61Y, 61M, and 61C move to the contact position, the K developing roller 61K moves to the contact position.

When moving the K developing roller 61K from the contact position to the separation position, the controller 2 turns on the K clutch 140K at a particular separation timing and the driving force from the developing motor 3D is transmitted to the K cam 150K. Then, the K cam 150K rotates and, as the sheet S moves, the K developing roller 61K starts moving toward the separation position at later timing than the C developing roller 61C. As a result, after the developing rollers 61Y, 61M, and 61C moves to the separation position, the K developing roller 61K moves to the separation position.

As shown in FIGS. 4A, 4B, 5A, and 5B, the image forming apparatus 1 includes separation sensors 4C and 4K. The separation sensor 4C is a phase sensor that detects the phases of the cams 150Y, 150M, and 150C. The separation sensor 4K is a phase sensor that detects the phase of the K cam 150K. The separation sensors 4C and 4K output a particular signal when the corresponding cam 150 is located within a particular phase range and does not output a signal when the corresponding cam 150 is not located within the particular phase range.

In particular, each of the separation sensors 4C and 4K has a light-emitting section 4P arranged to emit detection light and a light-receiving section 4R arranged to face the light-emitting section 4P and to receive the detection light from the light-emitting section 4P. The C cam 150C includes a first detected portion 154A protruding in the rotation axis direction of the C cam 150C. The K cam 150K includes two second detected portions 154K protruding in the rotation axis direction of the K cam 150K. The first detected portion 154A is arranged at a position where the first detected portion 154A is detected by the separation sensor 4C at a timing at which the C developing roller 61C has moved to the separation position from the contact position. The two second detected portions 154K are arranged at two positions where the two second detected portions 154K are detected by the separation sensor 4K at a timing at which the K developing roller 61K has moved to the separation position from the contact position.

The separation sensors 4C and 4K output a signal when the existence of the detected portions 154A and 154K between the light-emitting section 4P and the light-receiving section 4R blocks the detection light from entering the light-emitting section 4P and the light-receiving section 4R does not receive the detection light. The separation sensors 4C and 4K do not output a signal when the detected portions 154A and 154K have shifted from between the light-emitting section 4P and the light-receiving section 4R and the light-receiving section 4R receives the detection light from the light-emitting section 4P. The separation sensor 4C directly detects the phase of the C cam 150C, but also indirectly detects the phases of the cams 150Y and 150M.

In the following section, when a signal is outputted, this state may be referred to as "ON", and when no signal is outputted, this state may be referred to as "OFF". The voltage may be higher when a signal is outputted, or may be higher when no signal is outputted. Although not shown, the M cam 150M having the same shape as the C cam 150C has a part which has the same shape as the first detected portion 154A. However, the image forming apparatus 1 has no separation sensor for the M cam 150M. Thus, this part of the M cam 150M does not function as a detected portion.

The controller 2 is a device that controls the operation of the image forming apparatus 1. The controller 2 has a CPU, a ROM, a RAM, and input/output interfaces and executes programs stored therein to thereby execute various processing. In this embodiment, the controller 2 controls the YMC clutch 140A and the K clutch 140K based on the signals from the pre-registration sensor 28B, the post-registration sensor 28C, and the separation sensors 4C and 4K, thereby controlling the contact and the separation of the developing roller 61 relative to the photosensitive drum 50.

When forming a color image on one sheet S, the controller 2 executes control as described below. In the image forming apparatus 1, before an image is formed on the sheet S, all the developing rollers 61 (61Y, 61M, 61C, and 61K) are located at the separation position.

In a case where the length of one sheet S in the conveyance direction (hereinafter simply referred to as "the length of the sheet S") is longer than a first length, the controller 2 drives the first moving mechanism 5A to move the developing rollers 61Y, 61M, and 61C from the separation position to the contact position, and subsequently stops the driving of the first moving mechanism 5A temporarily. Thereafter, the controller 2 drives the first moving mechanism 5A again at a particular first timing to move the developing rollers 61Y, 61M, and 61C from the contact position to the separation position.

In a case where the length of the sheet S is shorter than or equal to the first length, the controller 2 drives the first moving mechanism 5A to move the developing rollers 61Y, 61M, and 61C from the separation position to the contact position and thereafter to move the developing rollers 61Y, 61M, and 61C from the contact position to the separation position without stopping the driving of the first moving mechanism 5A.

The first length is the length obtained by adding a particular first margin to the shorter of the first distance and the second distance described later. The first distance is the movement distance of the sheet S during a first contact time TC1 (see FIG. 3) in which the Y developing roller 61Y is located at the contact position, in a case where the first moving mechanism 5A (the Y cam 150Y) is continuously driven to move the Y developing roller 61Y located at the separation position to the contact position and then move the Y developing roller 61Y from the contact position to the separation position. The second distance is the movement distance of the sheet S during a third contact time TC3 (see FIG. 3) in which the developing rollers 61M and 61C are located at the contact position, in a case where the first moving mechanism 5A (the cams 150M and 150C) is continuously driven to move the developing rollers 61M and 61C located at the separation position to the contact position and then move the developing rollers 61M and 61C from the contact position to the separation position.

Specifically, in order to realize the control to form the color image as described above, the controller 2 executes the processing described below.

Specifically, in order to form a color image on one sheet S, the controller 2 drives the first moving mechanism 5A to move the developing rollers 61Y, 61M, and 61C from the separation position to the contact position. If the post-registration sensor 28C is detecting the one sheet S at the time when the first time has elapsed, the driving of the first moving mechanism 5A is temporarily stopped after the developing rollers 61Y, 61M, and 61C are moved to the contact position. Thereafter, at the first timing, the controller 2 drives the first moving mechanism 5A to move the developing rollers 61Y, 61M, and 61C from the contact position to the separation position.

On the other hand, if the post-registration sensor 28C is not detecting one sheet S at the time when the first time has elapsed when the controller 2 drives the first moving mechanism 5A to move the developing rollers 61Y, 61M, and 61C from the separation position to the contact position, the developing rollers 61Y, 61M, and 61C are moved from the contact position to the separation position without stopping the driving of the first moving mechanism 5A after the developing rollers 61Y, 61M, and 61C are moved to the contact position.

More specifically, the controller 2 causes the cams 150Y, 150M, and 150C to rotate to move the developing rollers 61Y, 61M, and 61C from the separation position to the contact position. If the post-registration sensor 28C is detecting one sheet S at the time when a particular time T12 has elapsed since the rotation of the cams 150Y, 150M, and 150C are started, the cams 150Y, 150M, and 150C are temporarily stopped after the developing rollers 61Y, 61M, and 61C has moved to the contact position. Thereafter, at the timing when a particular time T13 has elapsed since the sheet S passes the post-registration sensor 28C and the post-registration sensor 28C becomes OFF, the controller 2 causes the cams 150Y, 150M, and 150C to rotate again to move the developing rollers 61Y, 61M, and 61C from the contact position to the separation position.

The controller 2 causes the cams 150Y, 150M, and 150C to rotate to move the developing rollers 61Y, 61M, and 61C from the separation position to the contact position. And, if the post-registration sensor 28C is not detecting one sheet S at the time when the particular time T12 has elapsed since the rotation of the cams 150Y, 150M, and 150C is started, the controller 2 causes the cams 150Y, 150M, and 150C to rotate continuously after the developing rollers 61Y, 61M, and 61C have moved to the contact position without stopping the cams 150Y, 150M, and 150C, thereby moving the developing rollers 61Y, 61M, and 61C from the contact position to the separation position.

The operation of the K developing roller 61K when forming a color image on one sheet S will be described later.

When forming a monochrome image on one sheet S using only the K developing roller 61K, the controller 2 executes control as described below. When forming the monochrome image, the controller 2 keeps the developing rollers 61Y, 61M, and 61C at the separation position without moving the cams 150Y, 150M, and 150C (YMC clutch 140A).

In a case where one sheet S has a length longer than a second length, the controller 2 causes the K cam 150K to rotate to move the K developing roller 61K from the separation position to the contact position and subsequently temporarily stops the rotation of the K cam 150K. Thereafter, the controller 2 causes the K cam 150K to rotate again at a particular second timing to move the K developing roller 61K from the contact position to the separation position.

In a case where one sheet S has a length shorter than or equal to the second length, the controller 2 causes the K cam 150K to rotate to move the K developing roller 61K from the separation position to the contact position and subsequently move the K developing roller 61K from the contact position to the separation position, without stopping the rotation of the K cam 150K.

The second length is a length obtained by adding a particular second margin to a third distance described later. The third distance is the movement distance of the sheet S during a second contact time TC2 (see FIG. 3) in which the K developing roller 61K is located at the contact position, in a case where the K cam 150K is continuously rotated to move the K developing roller 61K located at the separation position to the contact position and then move the K developing roller 61K from the contact position to the separation position.

Specifically, in order to realize control when forming the monochrome image as described above, the controller 2 executes the processing as described below.

Specifically, the controller 2 causes the K cam 150K to rotate to move the K developing roller 61K from the separation position to the contact position and, if the post-registration sensor 28C is detecting one sheet S at the time when the particular time T22 has elapsed since the rotation of the K cam 150K is started, the controller 2 temporarily stops the K cam 150K after the K developing roller 61K has moved to the contact position. Thereafter, at the timing when a particular time T23 has elapsed since the sheet S passes the post-registration sensor 28C and the post-registration sensor 28C becomes OFF, the controller 2 causes the K cam 150K to rotate again to move the K developing roller 61K from the contact position to the separation position.

The controller 2 causes the K cam 150K to rotate to move the K developing roller 61K from the separation position to the contact position. And, if the post-registration sensor 28C is not detecting one sheet S at the time when the particular time T22 has elapsed since the rotation of the K cam 150K is started, the controller 2 causes the K cam 150K to rotate continuously after the K developing roller 61K has moved to the contact position, thereby moving the K developing roller 61K from the contact position to the separation position.

Next, the following section will describe in detail one example of the processing by the controller 2 with reference to FIGS. 6 to 11. In the timing charts such as FIG. 7, the operation of the Y developing roller 61Y (Y) is shown together with the operation of the M developing roller 61M (M) and the operation of the C developing roller 61C (C) by using different line types.

First, the following section will describe the processing when forming a color image on one sheet S.

Figure 6:
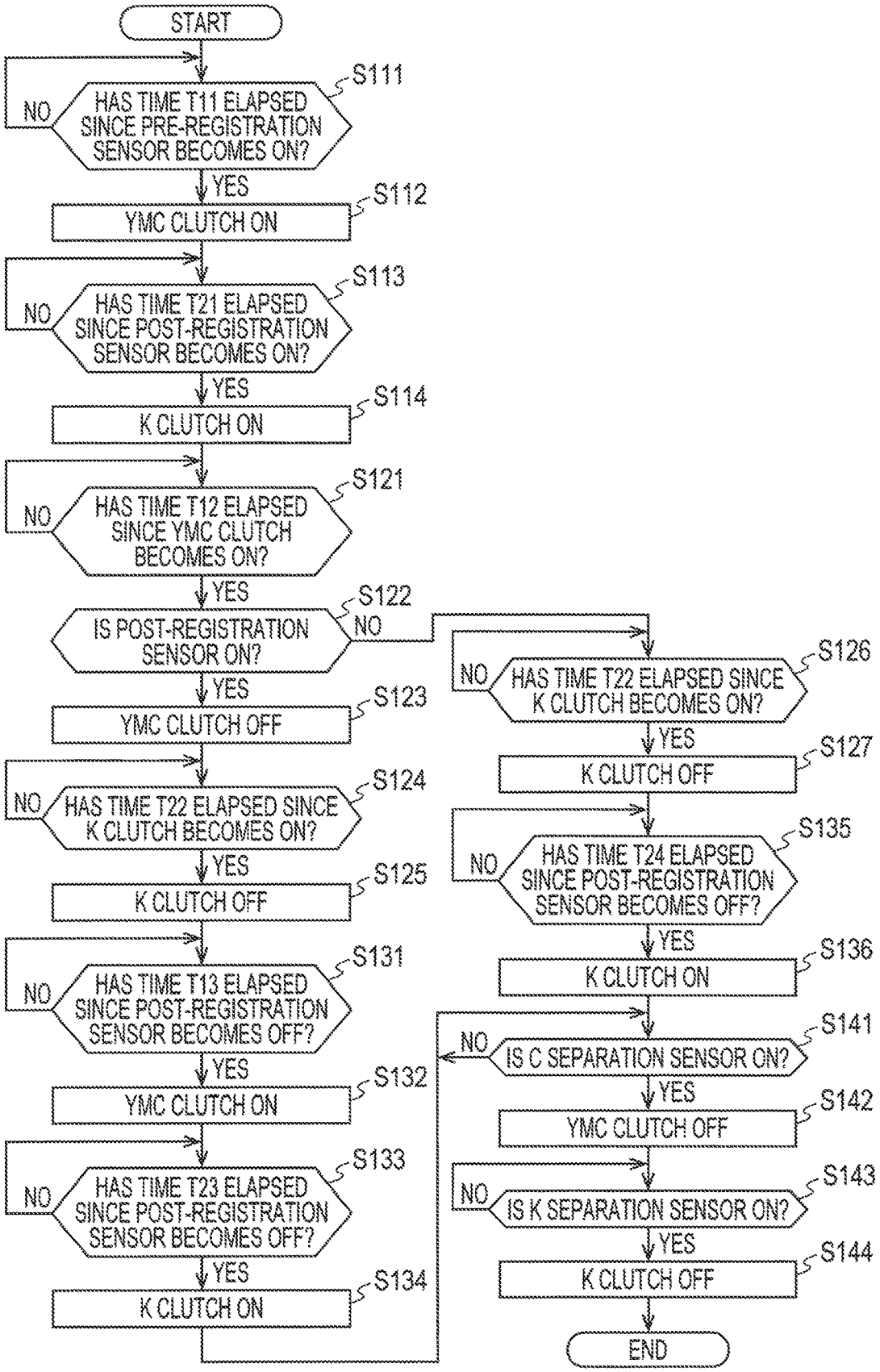
FIG. 6 is a flowchart showing an example of processing by a controller in a case where a color image is formed on one sheet.
Figure 7:
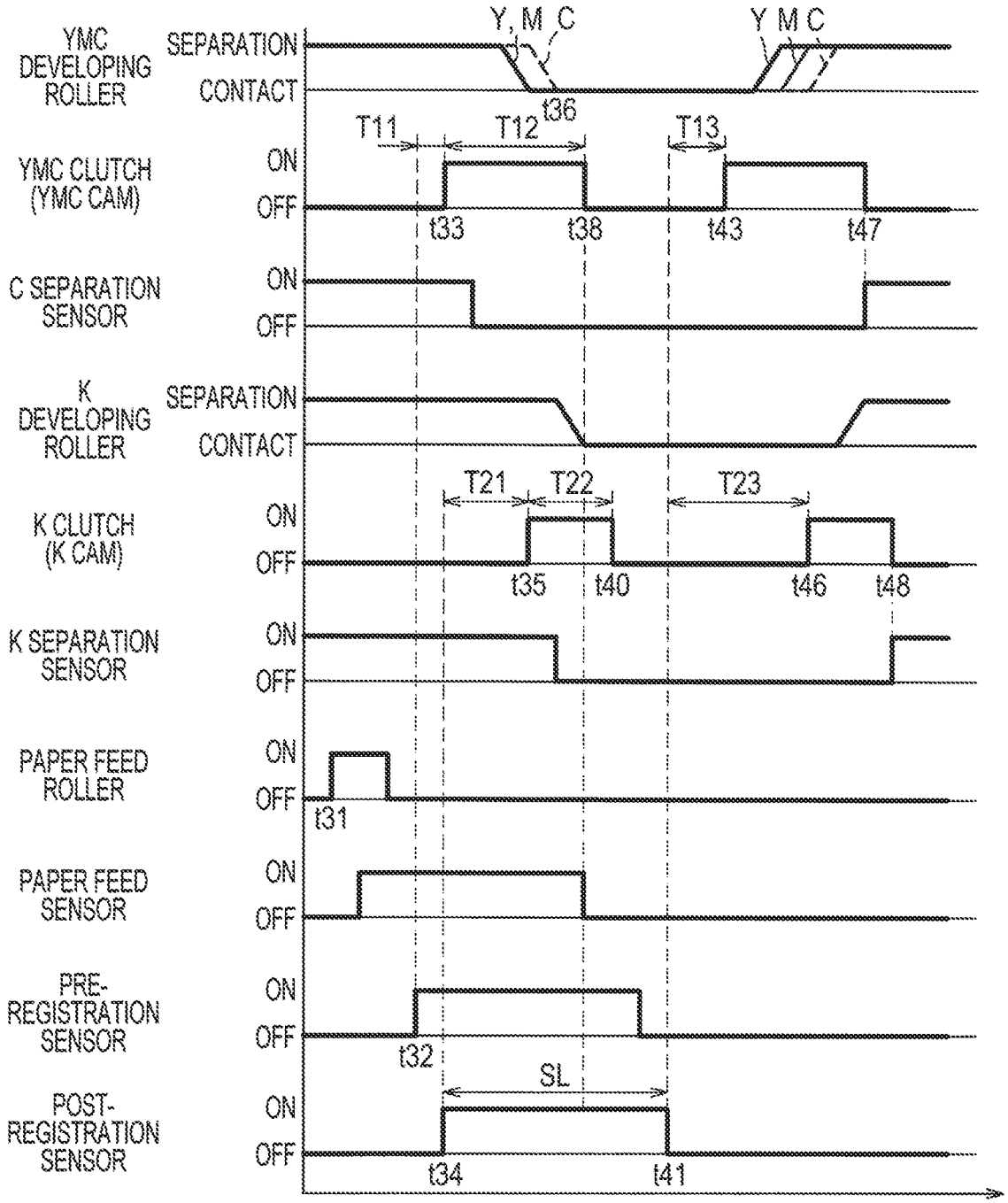
FIG. 7 is a timing chart showing operations of developing rollers and clutches when the length of a sheet is long in a case where a color image is formed on one sheet.

As shown in FIGS. 6 and 7, the sheet S in the sheet tray 21 is picked up by the paper feed roller 23 (t31). And, when a particular time T11 has elapsed since the leading end of the conveyed sheet S passes the pre-registration sensor 28B and the pre-registration sensor 28B becomes ON (t32) (S111: Yes), the controller 2 turns on the YMC clutch 140A (S112, t33) to rotate the cams 150Y, 150M, and 150C. As a result, the developing rollers 61Y, 61M, and 61C move from the separation position toward the contact position. Among the developing rollers 61Y, 61M, and 61C, the developing rollers 61Y and 61M reach the contact position substantially simultaneously, and thereafter the C developing roller 61C reaches the contact position. The particular time T11 is set to such a time that the development of the Y photosensitive drum 50Y by the Y developing roller 61Y is performed in time for the transfer of a toner image onto the conveyed sheet S.

When a particular time T21 has elapsed since the leading end of the conveyed sheet S passed the post-registration sensor 28C and the post-registration sensor 28C becomes ON (t34) (S113: Yes), the controller 2 turns on the K clutch 140K (S114, t35) to rotate the K cam 150K. As a result, the K developing roller 61K moves from the separation position toward the contact position. The K developing roller 61K reaches the contact position after the C developing roller 61C reaches the contact position. The particular time T21 is set to such a time that the development of the K photosensitive drum 50K by the K developing roller 61K is performed in time for the transfer of a toner image onto the conveyed sheet S.

When a particular time T12 has elapsed since the YMC clutch 140A becomes ON (t33) (S121: Yes), the controller 2 determines whether the post-registration sensor 28C still continues to detect the sheet S and is still ON (S122).

When the sheet S has a long length SL and the post-registration sensor 28C is ON (S122, Yes), the controller 2 turns off the YMC clutch 140A (S123, t38) and temporarily stops the cams 150Y, 150M, and 150C. The particular time T12 is set to a time that allows all of the developing rollers 61Y, 61M, and 61C to be located at the contact position. When a particular time T22 has elapsed since the K clutch 140K is turned on (t35) (S124: Yes), the controller 2 turns off the K clutch 140K (S125, t40) and stops the K cam 150K. The particular time T22 is set to a time that allows the K developing roller 61K to be located at the contact position.

Thereafter, when a particular time T13 has elapsed since the trailing end of the sheet S passes the post-registration sensor 28C and the post-registration sensor 28C is turned off (t41) (S131: Yes), the controller 2 turns on the YMC clutch 140A again (S132, t43) and causes the cams 150Y, 150M, and 150C to rotate. As a result, the developing rollers 61Y, 61M, and 61C are moved from the contact position toward the separation position. The developing rollers 61Y, 61M, and 61C reach the separation position in this order. The particular time T13 is set to such a time that the Y developing roller 61Y moves to the separation position after the development of the Y photosensitive drum 50Y by the Y developing roller 61Y is completed.

When the particular time T23 has elapsed since the post-registration sensor 28C is turned off (t41) (S133: Yes), the controller 2 turns on the K clutch 140K (S134, t46) and causes the K cam 150K to rotate. As a result, the K developing roller 61K moves from the contact position toward the separation position. After the C developing roller 61C reaches the separation position, the K developing roller 61K reaches the separation position. The particular time T23 is set to such a time that the K developing roller 61K moves to the separation position after the development of the K photosensitive drum 50K by the K developing roller 61K is completed.

Thereafter, when the developing rollers 61Y, 61M, and 61C move to the separation position and the cyan separation sensor 4C is switched from OFF to ON (S141: Yes), the controller 2 turns off the YMC clutch 140A (S142, t47) to stop the cams 150Y, 150M, and 150C. Further, when the K developing roller 61K moves to the separation position and the black separation sensor 4K is switched from OFF to ON (S143: Yes), the controller 2 turns off the K clutch 140K (S144, t48) to stop the K cam 150K. Then, the processing ends.

As shown in FIGS. 6 and 8, in S122, in a case where the sheet S has a short length SS and the sheet S already has passed the post-registration sensor 28C and the post-registration sensor 28C is OFF at the time when the particular time T12 has elapsed (t38) (S122: No), the controller 2 continues the rotation of the cams 150Y, 150M, and 150C without turning off the YMC clutch 140A. As a result, the developing rollers 61Y, 61M, and 61C move from the contact position toward the separation position.

When a particular time T22 has elapsed since the K clutch 140K is turned on (t35) (S126: Yes), the controller 2 turns off the K clutch 140K (S127, t40) to stop the K cam 150K. Thereafter, when a particular time T24 has elapsed since the post-registration sensor 28C is turned off (t37) (S135: Yes), the controller 2 turns on the K clutch 140K (S136, t42) to rotate the K cam 150K. As a result, the K developing roller 61K moves from the contact position toward the separation position. The particular time T24 is set to such a time that the K developing roller 61K moves to the separation position after the development of the K photosensitive drum 50K by the K developing roller 61K is completed.

Thereafter, when the developing rollers 61Y, 61M, and 61C move to the separation position and the separation sensor 4C is switched from OFF to ON (S141: Yes), the controller 2 turns off the YMC clutch 140A (S142, t44) to stop the cams 150Y, 150M, and 150C. When the K developing roller 61K moves to the separation position and the separation sensor 4K is switched from OFF to ON (S143: Yes), the controller 2 turns off the K clutch 140K (S144, t45) to stop the K cam 150K. Then, the processing ends.

Next, the following section will describe the processing when forming a monochrome image on one sheet S.

Figure 9:
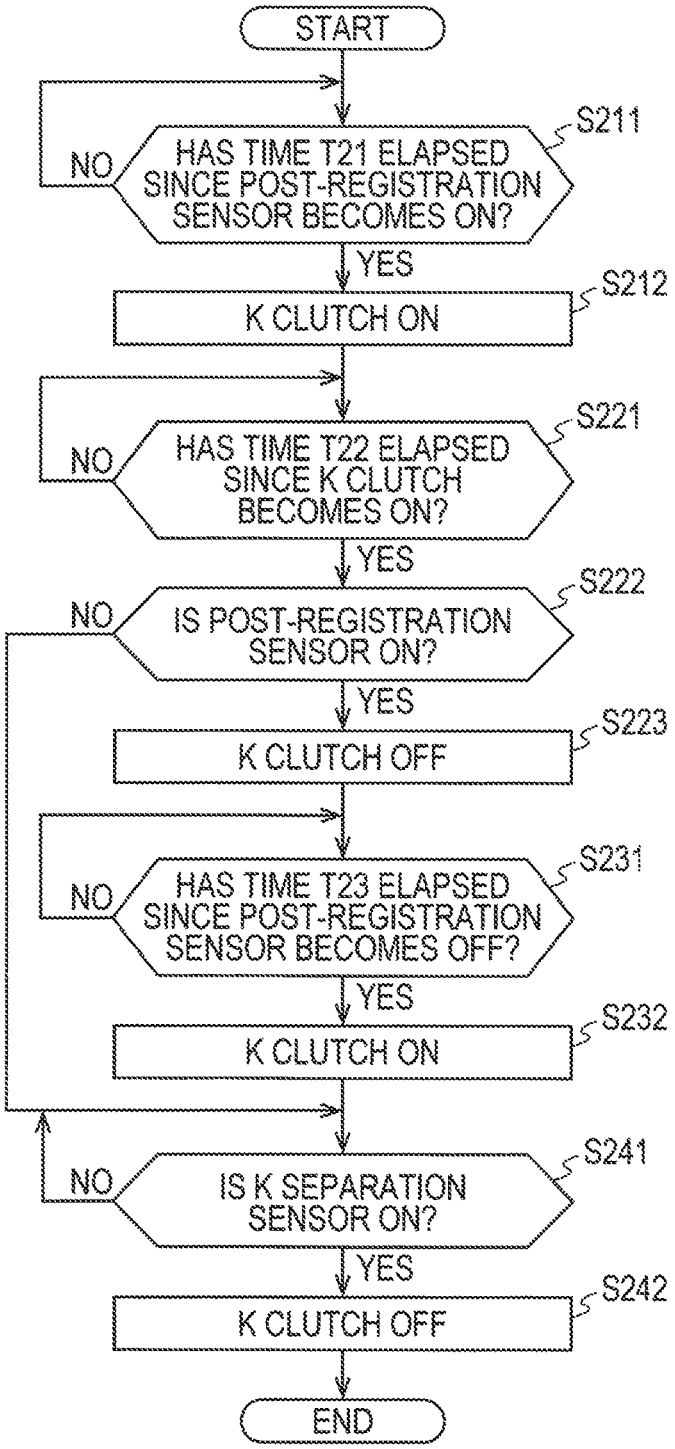
FIG. 9 is a flowchart showing an example of processing by the controller in a case where a monochrome image is formed on one sheet.
Figure 10:
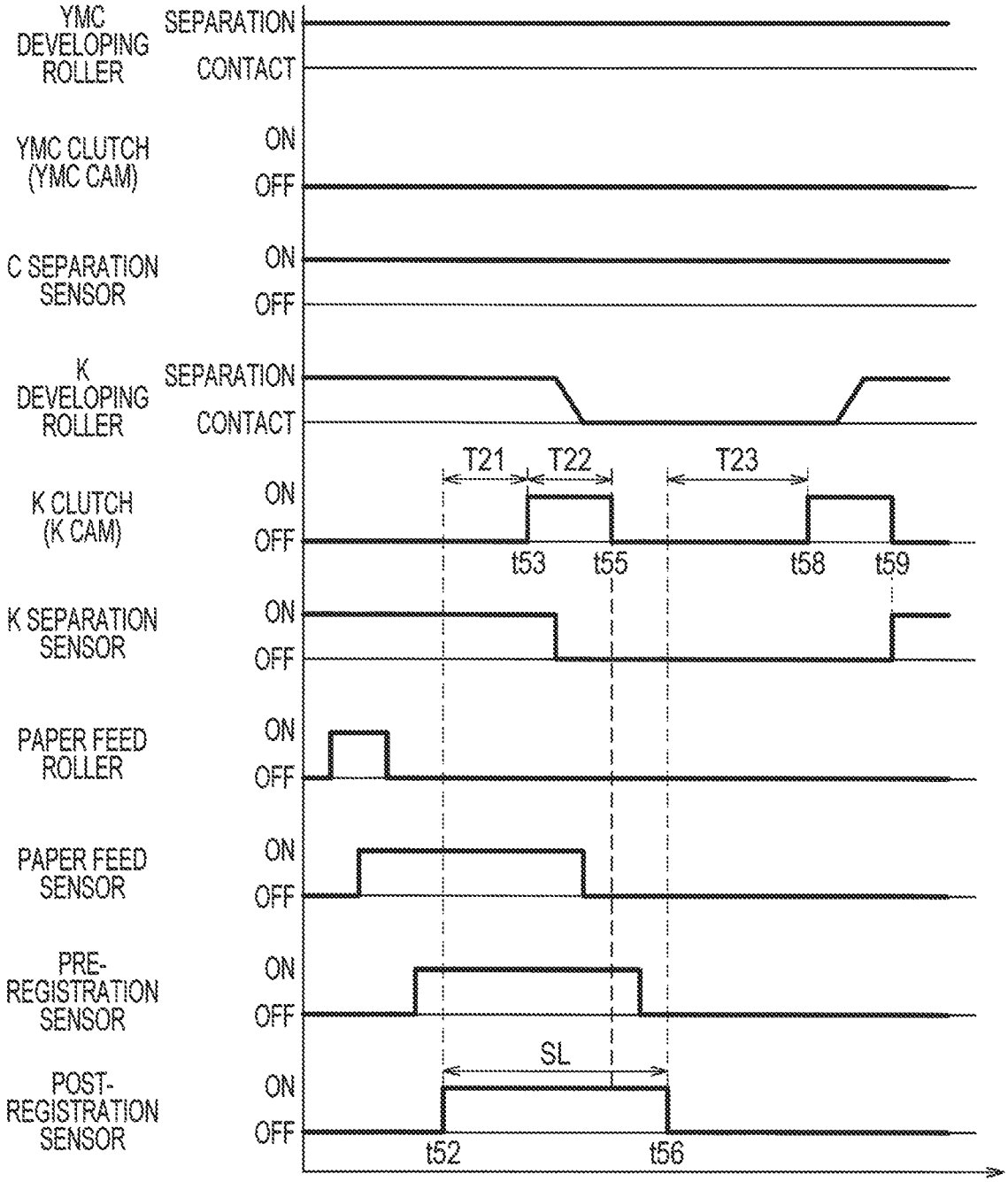
FIG. 10 is a timing chart showing operations of the developing rollers and the clutches when the length of a sheet is long in a case where a monochrome image is formed on one sheet.

As shown in FIGS. 9 and 10, when a particular time T21 has elapsed since the post-registration sensor 28C is turned on (t52) (S211: Yes), the controller 2 turns on the K clutch 140K (S212, t53) to rotate the K cam 150K. As a result, the K developing roller 61K moves from the separation position toward the contact position. The particular time when forming a monochrome image may be the same as or different from the particular time when forming a color image.

When a particular time T22 has elapsed since the K clutch 140K is turned on (t53) (S221: Yes), the controller 2 determines whether the post-registration sensor 28C is ON (S222).

When the sheet S has the long length SL and the post-registration sensor 28C is ON (S222, Yes), the controller 2 turns off the K clutch 140K (S223, t55) to temporarily stop the K cam 150K. Thereafter, when the particular time T23 has elapsed since the post-registration sensor 28C is turned off (t56) (S231: Yes), the controller 2 turns on the K clutch 140K again (S232, t58) to rotate the K cam 150K. As a result, the K developing roller 61K moves from the contact position to the separation position.

Thereafter, when the K developing roller 61K moves to the separation position and the separation sensor 4K is switched from OFF to ON (S241: Yes), the controller 2 turns off the K clutch 140K (S242, t59) to stop the K cam 150K. Then, the processing ends.

Figure 11:
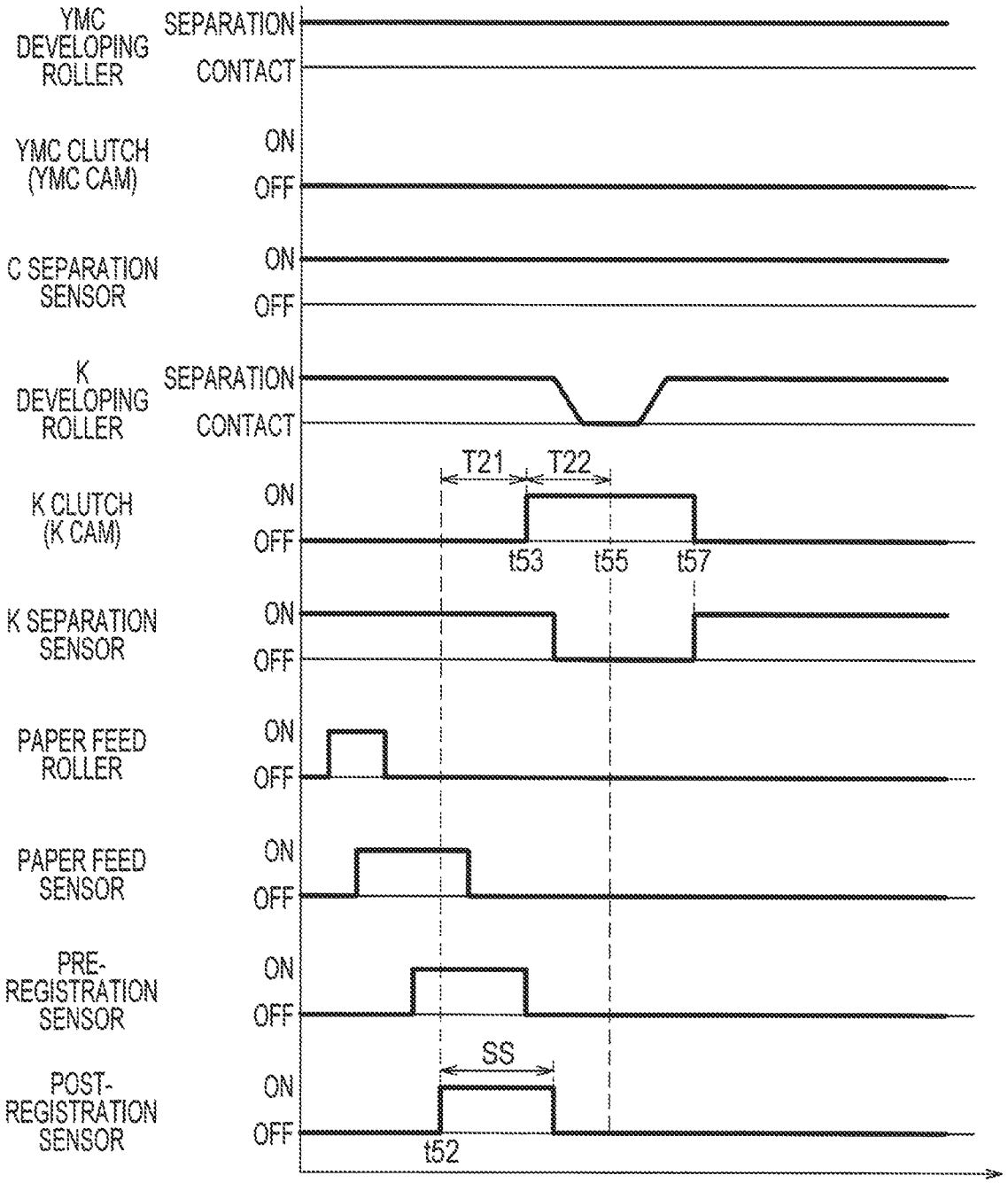
FIG. 11 is a timing chart showing operations of the developing rollers and the clutches when the length of a sheet is short in a case where a monochrome image is formed on one sheet.

As shown in FIGS. 9 and 11, in S222 (t55), in a case where the sheet S has the short length SS and the post-registration sensor 28C is OFF (S222: No), the controller 2 causes the K cam 150K to continuously rotate without turning off the K clutch 140K. As a result, the K developing roller 61K moves from the contact position toward the separation position.

Thereafter, when the K developing roller 61K moves to the separation position and the separation sensor 4K is switched from OFF to ON (S241: Yes), the controller 2 turns off the K clutch 140K (S242, t57) to stop the K cam 150K. Then, the processing ends.

According to the above-described embodiment, when the sheet S has a length shorter than or equal to the first length when forming a color image on one sheet S, the developing rollers 61Y, 61M, and 61C are moved from the contact position to the separation position without stopping the driving of the first moving mechanism 5A. This consequently reduces the time during which the developing rollers 61Y, 61M, and 61C are in contact with the corresponding photosensitive drums 50Y, 50M, and 50C.

In the above-described embodiment, a margin is added to the first length. Thus, even when there is a variation in the component size, for example, a color image transferred to one sheet S can be developed reliably, after which the developing rollers 61Y, 61M, and 61C are separated from the corresponding photosensitive drums 50Y, 50M, and 50C.

In the above-described embodiment, when the sheet S has a length shorter than or equal to the second length when forming a monochrome image on one sheet S, the K developing roller 61K is moved from the contact position to the separation position without stopping the rotation of the K cam 150K. This consequently reduces the time during which the K developing roller 61K is in contact with the K photosensitive drum 50K.

In the above-described embodiment, a margin added to the second length. Thus, even when there is a variation in the component size, for example, a monochrome image transferred to one sheet S can be developed reliably, after which the K developing roller 61K is separated from the K photosensitive drum 50K.

In the above-described embodiment, in the configuration in which the developing roller 61 rotates at the contact position and does not rotate at the separation position, the time is shortened during which the developing roller 61 is located at the contact position. Thus, the time of rotation of the developing roller 61 is shortened. This consequently suppresses the deterioration of the toner and the developing roller 61 due to the rotation of the developing roller 61.

While the disclosure has been described in detail with reference to the above aspects thereof, it would be apparent to those skilled in the art that various changes and modifications may be made therein without departing from the scope of the claims.

In the moving mechanism of the above-described embodiment, the rotary motion of the motor is converted into a reciprocating motion by using a cam and cam follower mechanism, and the developing roller is reciprocated between the contact position and the separation position. The mechanism that converts the rotary motion of the motor into the reciprocating motion is not limited to the cam and cam follower mechanism. Other mechanisms that convert a rotary motion into a reciprocating motion, such as a crank-link mechanism, may be used.

For example, in the above-described embodiment, the post-registration sensor 28C is illustrated as the sheet sensor, but the sheet sensor is not limited to this. The sheet sensor may be a sensor that detects a sheet other than the post-registration sensor 28C, such as the pre-registration sensor 28B.

In the above-described embodiment, the determination of whether to temporarily stop driving of the moving mechanism when forming an image on one sheet is made based on whether the sheet sensor detects a sheet when the drive mechanism is driven to move the developing roller from the separation position to the contact position and a particular time has passed. The method of determination is not limited to this. For example, the controller may calculate the length of the sheet from the detection results of the paper feed sensor 28A, the pre-registration sensor 28B, the post-registration sensor 28C, and so on, and compare the calculated length of the sheet with a threshold value (first length or second length). Then, the controller may temporarily stop the drive mechanism if the length of the sheet is larger than the threshold value, and not stop the drive mechanism if the length of the sheet is smaller than or equal to the threshold value.

The first moving mechanism 5A is configured such that the three developing rollers 61Y, 61M, and 61C are maintained at the contact position during the certain time TC (see FIG. 8). In this configuration, the controller 2 may perform the following processing when the first moving mechanism 5A is driven to move the plurality of developing rollers 61Y, 61M, and 61C from the separation position to the contact position in order to form a color image on one sheet S.

Figure 12:
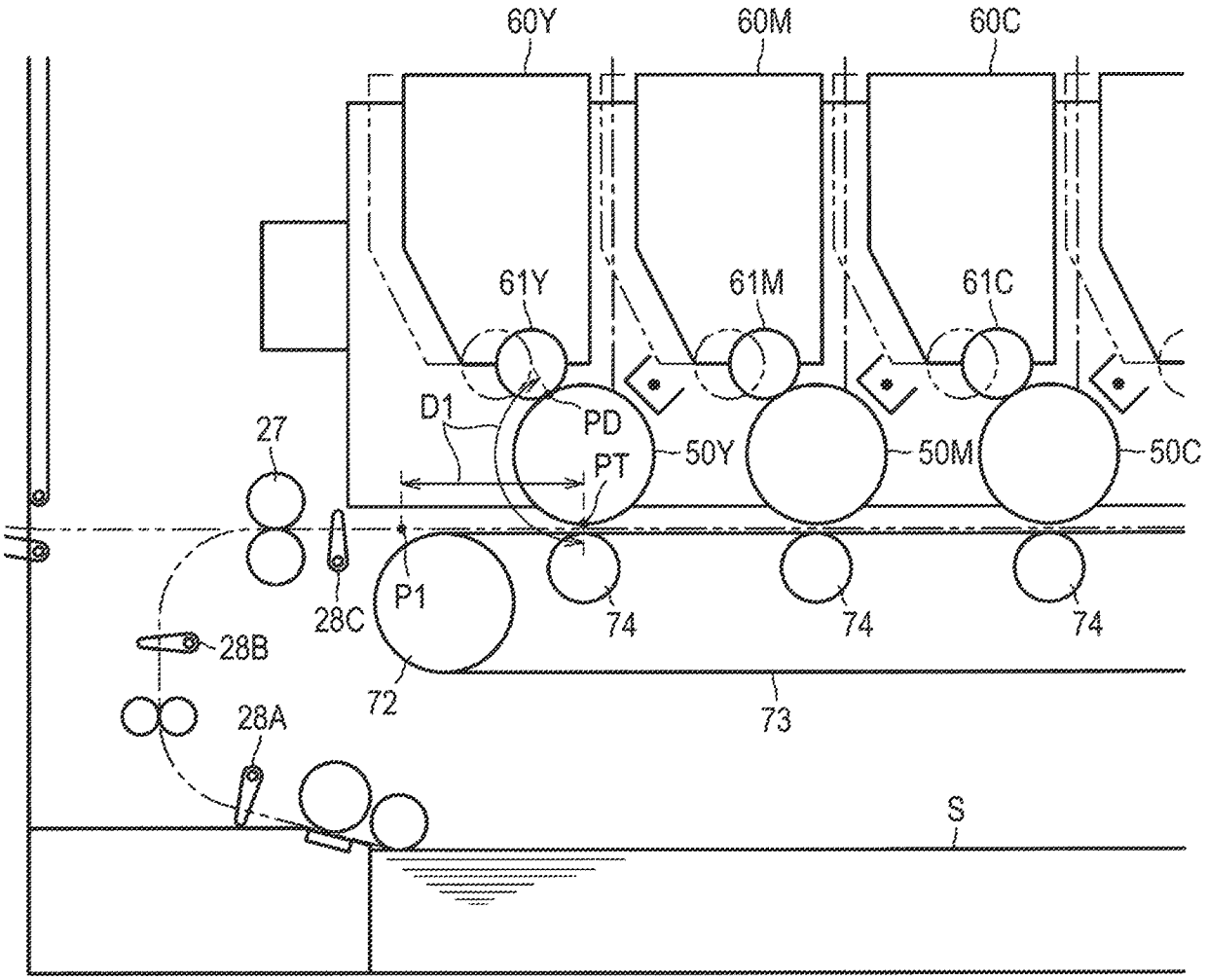
FIG. 12 is an explanatory diagram showing a development position, a transfer position, a first distance, and a first position in an image forming apparatus according to a modification.

That is, as shown in FIG. 12, if the trailing end of one sheet S has not yet passed a first position P1 described later at the timing when the C developing roller 61C moves to the contact position (see time t36 in FIG. 7), the controller 2 temporarily stops driving of the first moving mechanism 5A, and then drives the first moving mechanism 5A again at particular third timing to move the plurality of developing rollers 61Y, 61M, 61C from the contact position to the separation position.

Here, the first position P1 is a position on the conveyance path of sheet S (see the double-dot chain line), and is a position upstream of a transfer position PT by a first distance D1 in the conveyance direction of the sheet S. The first distance D1 is the distance along the circumferential surface of the Y photosensitive drum 50Y from a development position PD to the transfer position PT. The development position PD is the position where an electrostatic latent image on the Y photosensitive drum 50Y is developed to form a toner image. The transfer position PT is the position where the toner image formed on the Y photosensitive drum 50Y is transferred onto the sheet S.

Determination of whether the C developing roller 61C has moved to the contact position may be made, for example, based on whether a particular third time has elapsed from the time when the cyan separation sensor 4C becomes OFF. Specifically, when the third time has elapsed from the time when the separation sensor 4C becomes OFF, it can be determined that the C developing roller 61C has moved to the contact position.

The determination of whether the trailing end of one sheet S has passed the first position P1 at the timing when the C developing roller 61C moves to the contact position can be made based on the signal from the post-registration sensor 28C. Specifically, at the timing when the C developing roller 61C moves to the contact position, if a particular fourth time has elapsed from the time when the post-registration sensor 28C becomes OFF, it is determined that the trailing end of the sheet S has passed the first position P1. At the timing when the C developing roller 61C moves to the contact position, if the fourth time has not yet elapsed from the time when the post-registration sensor 28C becomes OFF or if the post-registration sensor 28C is still ON, it is determined that the trailing end of the sheet S has not yet passed the first position P1.

It is preferable that the third timing be timing at which the trailing end of one sheet S passes the first position P1. In this case, even if the sheet S has such a long length that the sheet S does not finish passing the first position P1 at the timing when the C developing roller 61C moves to the contact position, the timing of starting separation can be made as early as possible. Thus, even when the length of the sheet S is long, the contact time between the developing rollers 61Y, 61M, 61C and the corresponding photosensitive drums 50Y, 50M, 50C can be shortened.

On the other hand, the controller 2 may be configured to, if the trailing end of one sheet S has already passed the first position P1 at the timing when the C developing roller 61C moves to the contact position (see time t36 in FIG. 8), move the plurality of developing rollers 61Y, 61M, 61C from the contact position to the separation position without stopping the driving of the first moving mechanism 5A.

With this configuration, when the sheet S has such a short length that the sheet S finishes passing the first position P1 at the timing when the C developing roller 61C moves to the contact position, the plurality of developing rollers 61Y, 61M, 61C are moved from the contact position to the separation position without stopping the driving of the first moving mechanism 5A. Thus, the contact time between the developing rollers 61Y, 61M, 61C and the corresponding photosensitive drums 50Y, 50M, 50C can be shortened.

In the above-described embodiment, the plurality of photosensitive drums includes three photosensitive drums 50Y, 50M, and 50C, and the plurality of developing rollers includes three developing rollers 61Y, 61M, and 61C. Alternatively, the number of plurality of photosensitive drums and the plurality of developing rollers may be two or four or more.

In the above-described embodiment, the image forming apparatus 1 that forms an image by using four colors of toner is illustrated. For example, the image forming apparatus may be an image forming apparatus that forms an image by using toner of two colors, three colors, or five or more colors. Further, the image forming apparatus may be an image forming apparatus that forms an image by using toner of only one color. That is, the image forming apparatus may be configured to include the K photosensitive drum 50K, the K developing roller 61K, the K cam 150K, and the controller 2, without including the photosensitive drums 50Y, 50M, 50C, the developing rollers 61Y, 61M, 61C, and the cams 150Y, 150M, 150C used for forming a color image. Further, the image forming apparatus is not limited to a printer, and may be a multifunction peripheral, a copier, and so on.

The elements described in the above embodiments and modifications may be combined as appropriate.

What is claimed is:

1. An image forming apparatus comprising:

a plurality of photosensitive drums including a first photosensitive drum and a second photosensitive drum, the second photosensitive drum being disposed downstream of the first photosensitive drum in a conveyance direction of a sheet;

a plurality of developing rollers including a first developing roller and a second developing roller, the first developing roller being configured to move between a contact position at which the first developing roller contacts the first photosensitive drum and a separation position at which the first developing roller is separated from the first photosensitive drum, the second developing roller being configured to move between a contact position at which the second developing roller contacts the second photosensitive drum and a separation position at which the second developing roller is separated from the second photosensitive drum;

a moving mechanism configured to move the plurality of developing rollers between the contact position and the separation position such that, when the plurality of developing rollers moves from the separation position to the contact position, the second developing roller moves to the contact position after the first developing roller moves to the contact position, and when the plurality of developing rollers moves from the contact position to the separation position, the second developing roller moves to the separation position after the first developing roller moves to the separation position;

a motor;

a gear train comprising a clutch configured to transmit a driving force of the motor to the plurality of developing rollers located at the contact position and not to transmit the driving force of the motor to the plurality of developing rollers located at the separation position; and a controller configured to, when forming an image on one sheet, in a case where a length of the one sheet in the conveyance direction is larger than a first length, drive the moving mechanism to move the plurality of developing rollers from the separation position to the contact position, temporarily stop driving of the moving mechanism, and then, at a first timing, again drive the moving mechanism to move the plurality of developing rollers from the contact position to the separation position; and in a case where the length of the one sheet in the conveyance direction is smaller than or equal to the first length, drive the moving mechanism to move the plurality of developing rollers from the separation position to the contact position and then to move the plurality of developing rollers from the contact position to the separation position without stopping driving of the moving mechanism.

2. The image forming apparatus according to claim 1, wherein a first distance is a distance by which a sheet moves during a period in which the first developing roller is located at the contact position in a case where the moving mechanism is continuously driven to move the first developing roller located at the separation position to the contact position and to then move the first developing roller to the separation position again;

wherein a second distance is a distance by which a sheet moves during a period in which the second developing roller is located at the contact position in a case where the moving mechanism is continuously driven to move the second developing roller located at the separation position to the contact position and to then move the second developing roller to the separation position again; and wherein the first length is obtained by adding a particular margin to a smaller one of the first distance and the second distance.

3. The image forming apparatus according to claim 1, further comprising a sheet sensor configured to detect a sheet, the sheet sensor being disposed upstream of the plurality of photosensitive drums in the conveyance direction, wherein the controller is configured to, when the moving mechanism is driven to move the plurality of developing rollers from the separation position to the contact position for forming an image on one sheet and a first time has elapsed:

in a case where the sheet sensor detects the one sheet, temporarily stop driving of the moving mechanism after the plurality of developing rollers moves to the contact position, and then again drive the moving mechanism at the first timing to move the plurality of developing rollers from the contact position to the separation position; and in a case where the sheet sensor does not detect the one sheet, after the plurality of developing rollers moves to the contact position, drive the moving mechanism to move the plurality of developing rollers from the contact position to the separation position without stopping driving of the moving mechanism.

4. The image forming apparatus according to claim 1, wherein the plurality of photosensitive drums further includes a third photosensitive drum disposed between the first photosensitive drum and the second photosensitive drum in the conveyance direction;

wherein the plurality of developing rollers further includes a third developing roller configured to move between a contact position at which the third developing roller contacts the third photosensitive drum and a separation position at which the third developing roller is separated from the third photosensitive drum;

wherein the moving mechanism is configured such that:

when the plurality of developing rollers moves from the separation position to the contact position, the third developing roller moves to the contact position after the first developing roller moves to the contact position and before the second developing roller moves to the contact position; and when the plurality of developing rollers moves from the contact position to the separation position, the third developing roller moves to the separation position after the first developing roller moves to the separation position and before the second developing roller moves to the separation position.

5. The image forming apparatus according to claim 1, wherein the moving mechanism comprises a plurality of cams, each of the plurality of cams being configured to rotate to move a corresponding one of the plurality of developing rollers between the contact position and the separation position.

6. The image forming apparatus according to claim 5, further comprising:

a support member rotatably supporting the plurality of photosensitive drums, the support member having a plurality of springs; and a plurality of developing cartridges including respective ones of the plurality of developing rollers, each of the plurality of developing cartridges having a pressed portion, wherein each of the plurality of springs is configured to press a corresponding one of the plurality of developing cartridges in a direction from the separation position toward the contact position;

wherein each of the plurality of cams is configured to, in a certain angular range, press the pressed portion in a direction from the contact position toward the separation position;

wherein, in a state where each of the plurality of cams presses the pressed portion, a corresponding one of the plurality of developing rollers is located at the separation position; and wherein, in a state where each of the plurality of cams does not press the pressed portion, the corresponding one of the plurality of developing rollers is located at the contact position.

7. An image forming apparatus comprising:

a photosensitive drum;

a developing roller configured to move between a contact position at which the developing roller contacts the photosensitive drum and a separation position at which the developing roller is separated from the photosensitive drum;

a cam configured to rotate to move the developing roller between the contact position and the separation position;

a motor;

a gear train comprising a clutch configured to transmit a driving force of the motor to the developing roller located at the contact position and not to transmit the driving force of the motor to the developing roller located at the separation position; and a controller configured to, when forming an image on one sheet, in a case where a length of the one sheet in the conveyance direction is larger than a particular length, rotate the cam to move the developing roller from the separation position to the contact position, temporarily stop rotation of the cam, and then at a particular timing again rotate the cam to move the developing roller from the contact position to the separation position; and in a case where the length of the one sheet in the conveyance direction is smaller than or equal to the particular length, rotate the cam to move the developing roller from the separation position to the contact position and then to move the developing roller from the contact position to the separation position without stopping rotation of the cam.

8. The image forming apparatus according to claim 7, wherein the particular length is obtained by adding a particular margin to a distance by which a sheet moves during a period in which the developing roller is located at the contact position in a case where the cam is continuously rotated to move the developing roller located at the separation position to the contact position and to then move the developing roller to the separation position again.

9. An image forming apparatus comprising:

a plurality of photosensitive drums including a first photosensitive drum and a second photosensitive drum, the second photosensitive drum being disposed downstream of the first photosensitive drum in a conveyance direction of a sheet;

a plurality of developing rollers including a first developing roller and a second developing roller, the first developing roller being configured to move between a contact position at which the first developing roller contacts the first photosensitive drum and a separation position at which the first developing roller is separated from the first photosensitive drum, the second developing roller being configured to move between a contact position at which the second developing roller contacts the second photosensitive drum and a separation position at which the second developing roller is separated from the second photosensitive drum;

a moving mechanism configured to move the plurality of developing rollers between the contact position and the separation position such that, when the plurality of developing rollers moves from the separation position to the contact position, the second developing roller moves to the contact position after the first developing roller moves to the contact position, and when the plurality of developing rollers moves from the contact position to the separation position, the second developing roller moves to the separation position after the first developing roller moves to the separation position, the moving mechanism being configured such that, when driven continuously, the plurality of developing rollers is maintained at the contact position for a certain time after the second developing roller moves to the contact position and until the first developing roller starts moving from the contact position to the separation position; and a controller configured to, when driving the moving mechanism to move the plurality of developing rollers from the separation position to the contact position for forming an image on one sheet:

in a case where a trailing end of the one sheet has not passed a first position at a timing when the second developing roller moves to the contact position, temporarily stop driving of the moving mechanism and then at a particular timing again drive the moving mechanism to move the plurality of developing rollers from the contact position to the separation position; and in a case where the trailing end of the one sheet has passed the first position at the timing when the second developing roller moves to the contact position, move the plurality of developing rollers from the contact position to the separation position without stopping driving of the moving mechanism, the first position being a position on a sheet conveyance path and upstream of a transfer position by a first distance in the conveyance direction, the first distance being a distance from a developing position to the transfer position along a circumferential surface of the first photosensitive drum, the developing position being a position at which an electrostatic latent image on the first photosensitive drum is developed to form a toner image, the transfer position being a position at which the toner image formed on the first photosensitive drum is transferred onto the sheet.

10. The image forming apparatus according to claim 9, wherein the particular timing is a timing at which the trailing end of the one sheet passes the first position.

11. An image forming apparatus comprising:

a plurality of photosensitive drums including a first photosensitive drum and a second photosensitive drum, the second photosensitive drum being disposed downstream of the first photosensitive drum in a conveyance direction of a sheet;

a plurality of developing rollers including a first developing roller and a second developing roller, the first developing roller being configured to move between a contact position at which the first developing roller contacts the first photosensitive drum and a separation position at which the first developing roller is separated from the first photosensitive drum, the second developing roller being configured to move between a contact position at which the second developing roller contacts the second photosensitive drum and a separation position at which the second developing roller is separated from the second photosensitive drum;

a moving mechanism configured to move the plurality of developing rollers between the contact position and the separation position such that, when the plurality of developing rollers moves from the separation position to the contact position, the second developing roller moves to the contact position after the first developing roller moves to the contact position, and when the plurality of developing rollers moves from the contact position to the separation position, the second developing roller moves to the separation position after the first developing roller moves to the separation position; and a controller configured to, when forming an image on one sheet, in a case where a length of the one sheet in the conveyance direction is larger than a first length, drive the moving mechanism to move the plurality of developing rollers from the separation position to the contact position, temporarily stop driving of the moving mechanism, and then, at a first timing, again drive the moving mechanism to move the plurality of developing rollers from the contact position to the separation position; and in a case where the length of the one sheet in the conveyance direction is smaller than or equal to the first length, drive the moving mechanism to move the plurality of developing rollers from the separation position to the contact position and then to move the plurality of developing rollers from the contact position to the separation position without stopping driving of the moving mechanism, wherein a first distance is a distance by which a sheet moves during a period in which the first developing roller is located at the contact position in a case where the moving mechanism is continuously driven to move the first developing roller located at the separation position to the contact position and to then move the first developing roller to the separation position again;

wherein a second distance is a distance by which a sheet moves during a period in which the second developing roller is located at the contact position in a case where the moving mechanism is continuously driven to move the second developing roller located at the separation position to the contact position and to then move the second developing roller to the separation position again; and wherein the first length is obtained by adding a particular margin to a smaller one of the first distance and the second distance.

* * * * *